US009489909B2

(12) United States Patent
Hong et al.

(10) Patent No.: US 9,489,909 B2
(45) Date of Patent: Nov. 8, 2016

(54) METHOD OF DRIVING A DISPLAY PANEL, DISPLAY PANEL DRIVING APPARATUS FOR PERFORMING THE METHOD AND DISPLAY APPARATUS HAVING THE DISPLAY PANEL DRIVING APPARATUS

(71) Applicant: SAMSUNG DISPLAY CO., LTD., Yongin, Gyeonggi-Do (KR)

(72) Inventors: Seok-Ha Hong, Yongin-si (KR); Joon-Chul Goh, Hwaseong-si (KR); Bong-Hyun You, Yongin-si (KR); Dae-Gwang Jang, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 21 days.

(21) Appl. No.: 14/463,577

(22) Filed: Aug. 19, 2014

(65) Prior Publication Data

US 2015/0179117 A1 Jun. 25, 2015

(30) Foreign Application Priority Data

Dec. 19, 2013 (KR) ..... 10-2013-0159697

(51) Int. Cl.
*G09G 3/36* (2006.01)

(52) U.S. Cl.
CPC ..... *G09G 3/3648* (2013.01); *G09G 2320/028* (2013.01); *G09G 2320/0276* (2013.01); *G09G 2320/068* (2013.01); *G09G 2320/0673* (2013.01); *G09G 2320/0686* (2013.01); *G09G 2354/00* (2013.01)

(58) Field of Classification Search
CPC ..... G09G 2320/0276; G09G 3/3648; G09G 2320/0673; G09G 2320/028; G09G 2320/0261; G09G 2320/0626; G09G 2320/066; G09G 2300/0452; G09G 2320/0233; G09G 2320/0242; G09G 3/2003; G09G 3/36; G09G 3/2022; H04N 5/202; H04N 9/69
USPC ..... 345/6, 87–102, 690, 204, 419
See application file for complete search history.

(56) References Cited

U.S. PATENT DOCUMENTS

| | | | | |
|---|---|---|---|---|
| 8,427,476 | B2 | 4/2013 | Chen et al. | |
| 2005/0117186 | A1* | 6/2005 | Li | G02B 27/0093 359/15 |
| 2005/0276088 | A1* | 12/2005 | Moon | G09G 3/3648 365/63 |
| 2009/0309867 | A1* | 12/2009 | Shin | G09G 3/3614 345/214 |
| 2009/0315924 | A1 | 12/2009 | Chou | |
| 2010/0007639 | A1* | 1/2010 | Jeong | G09G 3/2007 345/208 |

(Continued)

FOREIGN PATENT DOCUMENTS

| | | | | |
|---|---|---|---|---|
| JP | 2000-276123 | | 10/2000 | |
| JP | GB 2467898 A | * | 8/2010 | G02B 27/0093 |

(Continued)

*Primary Examiner* — Hong Zhou
(74) *Attorney, Agent, or Firm* — Lewis Roca Rothgerber Christie LLP

(57) ABSTRACT

A method of driving a display panel includes detecting a position of a viewer to output a viewer position detection signal, determining whether the position of the viewer is in a first area or in a second area based on the viewer position detection signal to output a viewer position signal, and driving a unit pixel of the display panel using a plurality of gamma values according to the viewer position signal. The first area is less than a reference distance, and the second area is not less than the reference distance. Thus, side visibility of a display apparatus may be improved.

16 Claims, 23 Drawing Sheets

(56) References Cited

U.S. PATENT DOCUMENTS

2011/0242149 A1* 10/2011 Yoshida ..... G09G 3/3648 345/690
2012/0147065 A1* 6/2012 Byun ..... G09G 3/3208 345/690
2012/0154428 A1 6/2012 Barnhoefer
2012/0169787 A1* 7/2012 Chen ..... G09G 3/3614 345/690
2012/0194572 A1* 8/2012 Saitoh ..... G09G 5/06 345/690
2012/0242719 A1* 9/2012 Klompenhouwer . G09G 3/2074 345/690
2013/0194170 A1* 8/2013 Saitoh ..... G09G 3/20 345/103
2013/0278790 A1* 10/2013 Oh ..... H04N 5/202 348/223.1

FOREIGN PATENT DOCUMENTS

JP 2011-123084 6/2011
KR 10-2004-0023088 3/2004
KR 10-2008-0096131 10/2008

* cited by examiner

METHOD OF DRIVING A DISPLAY PANEL, DISPLAY PANEL DRIVING APPARATUS FOR PERFORMING THE METHOD AND DISPLAY APPARATUS HAVING THE DISPLAY PANEL DRIVING APPARATUS

CROSS-REFERENCE TO RELATED APPLICATION

This application claims priority to and the benefit of Korean Patent Application No. 10-2013-0159697, filed on Dec. 19, 2013 in the Korean Intellectual Property Office (KIPO), the entire content of which is herein incorporated by reference.

BACKGROUND

1. Field

Aspects of embodiments of the present invention relate to a method of driving a display panel, a display, panel driving apparatus for performing the method, and a display apparatus including the display panel driving apparatus.

2. Description of the Related Art

A liquid crystal display apparatus may include a lower substrate, an upper substrate, and a liquid crystal layer. The lower substrate may include a thin film transistor and a pixel electrode. The upper substrate may include a common electrode. The liquid crystal layer may be interposed between the lower substrate and the upper substrate, and include liquid crystals whose alignment is changed by an electric field between a pixel voltage applied to the pixel electrode and a common voltage applied to the common electrode. Side visibility of the liquid crystal display apparatus may be less than front visibility of the liquid crystal display apparatus.

SUMMARY

Aspects of embodiments of the present invention relate to a method of driving a display panel, a display panel driving apparatus for performing the method, and a display apparatus including the display panel driving apparatus. Further aspects relate to a method of driving a display panel of a display apparatus configured to detect a position of a viewer, a display panel driving apparatus for performing the method, and a display apparatus including the display panel driving apparatus.

Embodiments of the present invention provide for a method of driving a display panel capable of improving side visibility of a display apparatus.

Embodiments of the present invention also provide for a display panel driving apparatus for performing the above-mentioned method.

Embodiments of the present invention also provide for a display apparatus including the above-mentioned display panel driving apparatus.

According to an embodiment of the present invention, a method of driving a display panel includes detecting a position of a viewer to output a viewer position detection signal, determining whether the position of the viewer is in a first area or in a second area based on the viewer position detection signal to output a viewer position signal, and driving a unit pixel of the display panel using a plurality of gamma values according to the viewer position signal. The first area is less than a reference distance, and the second area is not less than the reference distance.

In one embodiment, the driving of the unit pixel using the gamma values according to the viewer position signal may include driving the unit pixel using the gamma values when the position of the viewer is in the second area.

In one embodiment, the driving of the unit pixel using the gamma values according to the viewer position signal may include driving a first sub pixel of the unit pixel and a fourth sub pixel of the unit pixel using a first gamma value, and driving a second sub pixel of the unit pixel and a third sub pixel of the unit pixel using a second gamma value.

In one embodiment, the driving of the unit pixel using the gamma values according to the viewer position signal may include driving a first sub pixel of the unit pixel using a first gamma value and a third gamma value, driving a second sub pixel of the unit pixel using a second gamma value and a fourth gamma value, driving a third sub pixel of the unit pixel using the first gamma value and the third gamma value, and driving a fourth sub pixel of the unit pixel using the second gamma value and the fourth gamma value.

In one embodiment, the first gamma value may be a white color gamma value, the third gamma value may be a black color gamma value, and the second gamma value and the fourth gamma value may be between the first gamma value and the third gamma value.

In one embodiment, the driving of the unit pixel using the gamma values according to the viewer position signal may include driving a first sub pixel of the unit pixel using a first gamma value and a fifth gamma value less than the first gamma value, driving a second sub pixel of the unit pixel using a second gamma value and a sixth gamma value less than the second gamma value, driving a third sub pixel of the unit pixel using a third gamma value and a seventh gamma value less than the third gamma value, and driving a fourth sub pixel of the unit pixel using a fourth gamma value and an eighth gamma value less than the fourth gamma value.

In one embodiment, the first gamma value may be a white color gamma value, the seventh gamma value may be a black color gamma value, and the second gamma value, the third gamma value, and the fourth gamma value may be between the first gamma value and the seventh gamma value.

In one embodiment, the driving of the unit pixel using the gamma values according to the viewer position signal may include driving the unit pixel using a first gamma value and a third gamma value during an odd-numbered frame, and driving the unit pixel using a second gamma value and a fourth gamma value during an even-numbered frame.

In one embodiment, the first gamma value may be a white color gamma value, the third gamma value may be a black color gamma value, and the second gamma value and the fourth gamma value may be between the first gamma value and the third gamma value.

In one embodiment, the driving of the unit pixel using the gamma values according to the viewer position signal may include driving a first sub pixel of the unit pixel using a first gamma value and a fifth gamma value less than the first gamma value, and driving a second sub pixel of the unit pixel using a third gamma value and a seventh gamma value less than the third gamma value during an odd-numbered frame, and driving the first sub pixel of the unit pixel using a second gamma value and a sixth gamma value less than the second gamma value, and driving the second sub pixel of the unit pixel using a fourth gamma value and an eighth gamma value less than the fourth gamma value during an even-numbered frame.

In one embodiment, the driving of the unit pixel using the gamma values according to the viewer position signal may include driving a first sub pixel of the unit pixel using a first gamma value and a third gamma value, and driving a second sub pixel of the unit pixel using a second gamma value and a fourth gamma value during an odd-numbered frame, and driving the first sub pixel of the unit pixel using a fifth gamma value and a seventh gamma value, and driving the second sub pixel of the unit pixel using a sixth gamma value and an eighth gamma value during an even-numbered frame.

In one embodiment, the first gamma value may be a white color gamma value, the seventh gamma value may be a black color gamma value, and the second gamma value, the third gamma value, the fourth gamma value, the fifth gamma value, the sixth gamma value, and the eighth gamma value may be between the first gamma value and the seventh gamma value.

In one embodiment, the driving of the unit pixel using the gamma values according to the viewer position signal may include driving a first sub pixel of the unit pixel using a first gamma value and a ninth gamma value less than the first gamma value, driving a second sub pixel of the unit pixel using a second gamma value and a tenth gamma value less than the second gamma value, driving a third sub pixel of the unit pixel using a third gamma value and an eleventh gamma value less than the third gamma value, and driving a fourth sub pixel of the unit pixel using a fourth gamma value and a twelfth gamma value less than the fourth gamma value during an odd-numbered frame, and driving the first sub pixel of the unit pixel using a fifth gamma value and a thirteenth gamma value less than the fifth gamma value, driving the second sub pixel of the unit pixel using a sixth gamma value and a fourteenth gamma value less than the sixth gamma value, driving the third sub pixel of the unit pixel using a seventh gamma value and a fifteenth gamma value less than the seventh gamma value, and driving the fourth sub pixel of the unit pixel using an eighth gamma value and a sixteenth gamma value less than the eighth gamma value during an even-numbered frame.

In one embodiment, the first gamma value may be a white color gamma value, the fifteenth gamma value may be a black color gamma value, and the second gamma value, the third gamma value, the fourth gamma value, the fifth gamma value, the sixth gamma value, the seventh gamma value, and the eighth gamma value may be between the first gamma value and the fifteenth gamma value.

In one embodiment, the method may further include driving the unit pixel of the display panel using a single gamma value when the position of the viewer is in the first area according to the viewer position signal.

In one embodiment, the driving of the unit pixel using the gamma values according to the viewer position signal may include driving the unit pixel using a first gamma value during a first frame, driving the unit pixel using a second gamma value during a second frame, driving the unit pixel using a third gamma value during a third frame, and driving the unit pixel using a fourth gamma value during a fourth frame.

According to an embodiment of the present invention, a display panel driving apparatus includes a viewer position determining part and a data driving part. The viewer position determining part is configured to detect a position of a viewer to output a viewer position detection signal, and is configured to determine whether the position of the viewer is in a first area or in a second area based on the viewer position detection signal. The first area is less than a reference distance, and the second area is not less than the reference distance. The data driving part is configured to drive a unit pixel of a display panel using a plurality of gamma values according to the viewer position signal.

In one embodiment, the data driving part may be configured to drive the unit pixel using the gamma values when the position of the viewer is in the second area.

In one embodiment, the data driving part may be configured to further drive the unit pixel using a single gamma value when the position of the viewer is in the first area.

According to an embodiment of the present invention, a display apparatus includes a display panel and a display panel driving apparatus. The display panel is configured to display an image and includes a gate line and a data line. The display panel driving apparatus includes a gate driving part configured to output a gate signal to the gate line, a viewer position determining part configured to detect a position of a viewer viewing the image to output a viewer position detection signal and configured to determine whether the position of the viewer is in a first area or in a second area based on the viewer position detection signal, and a data driving part configured to drive a unit pixel of the display panel using a plurality of gamma values according to the viewer position signal. The first area is less than a reference distance, and the second area is not less than the reference distance.

According to aspects of the present invention, a unit pixel is driven using a plurality of gamma values and therefore, side visibility of a display apparatus may be improved. According to further aspects of the present invention, when a viewer is in an area where the viewer may recognize a change of resolution of an image when a unit pixel is driven using a plurality of gamma values, the unit pixel is instead driven using a single gamma value and therefore, a decrease of the resolution of the image displayed on a display panel may be reduced or prevented.

BRIEF DESCRIPTION OF THE DRAWINGS

The above and other features and aspects of the present invention will become more apparent by describing in detail example embodiments thereof with reference to the accompanying drawings, in which.

DETAILED DESCRIPTION INVENTION

Hereinafter, embodiments of the present invention will be explained in detail with reference to the accompanying drawings. Herein, the use of the term "may," when describing embodiments of the present invention, refers to "one or more embodiments of the present invention." In addition, the use of alternative language, such as "or," when describing embodiments of the present invention, refers to "one or more embodiments of the present invention" for each corresponding item listed.

Figure 1:
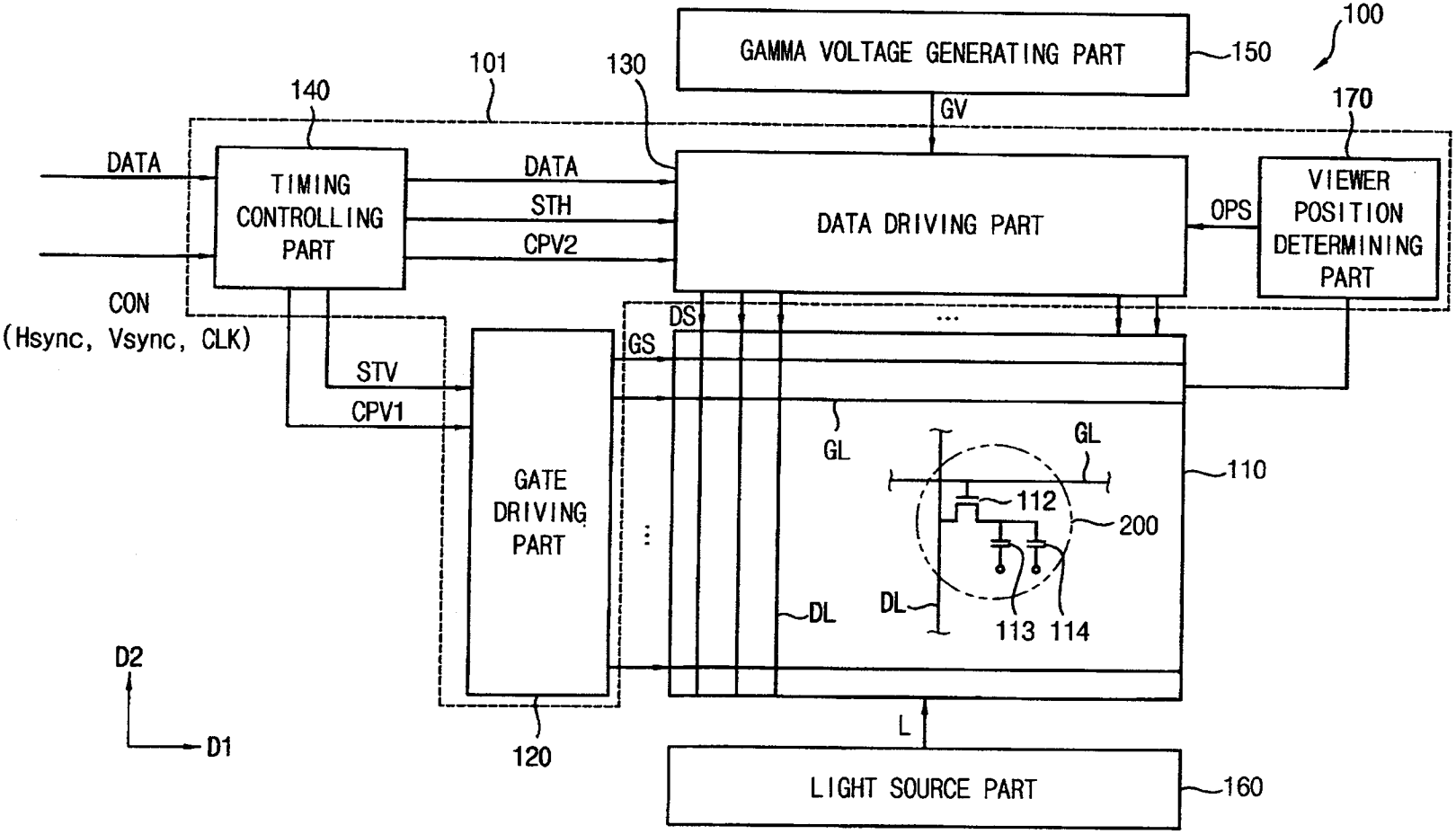
FIG. 1 is a block diagram illustrating a display apparatus according to an embodiment of the present invention.

FIG. 1 is a block diagram illustrating a display apparatus 100 according to an embodiment of the present invention.

Referring to FIG. 1, the display apparatus 100 includes a display panel 110, a display panel driving apparatus 101, a gamma voltage generating part 150, and a light source part 160. The display panel 110 receives a data signal DS based on image data DATA to display an image. For example, the image data DATA may be two-dimensional plane image data. In another embodiment, the image data DATA may include a left-eye image data and a right-eye image data for displaying a three-dimensional stereoscopic image.

The display panel 110 includes gate lines GL, data lines DL, and a plurality of unit pixels 200. The gate lines GL extend in a first direction D1 and the data lines DL extend in a second direction D2 substantially perpendicular to the first direction D1. The first direction D1 may be parallel with a long side of the display panel 110 and the second direction D2 may be parallel with a short side of the display panel 110. Each of the unit pixels 200 includes a thin film transistor 112 electrically connected to one of the gate lines GL and one of the data lines DL, a liquid crystal capacitor 113, and a storage capacitor 114 connected to the thin film transistor 112.

The display panel driving apparatus 101 includes a gate driving part 120, a data driving part 130, a timing controlling part 140, a viewer position determining part 170. The gate driving part 120 generates a gate signal GS in response to a gate start signal STV and a gate clock signal CPV1 provided from the timing controlling part 140, and outputs the gate signal GS to the gate lines GL.

The data driving part 130 outputs the data signal DS based on the image data DATA to the data lines DL in response to a data start signal STH and a data clock signal CPV2 provided from the timing controlling part 140. In addition, the data driving part 130 outputs the data signal DS using a gamma voltage GV provided from the gamma voltage generating part 150 according to a viewer position signal OPS provided from the viewer position determining part 170. The data driving part 130 may drive the display panel 110 using a single gamma value or a plurality of gamma values according to the viewer position signal OPS.

The timing controlling part 140 receives the image data DATA and a control signal CON from the outside. The control signal CON may include a horizontal synchronous signal Hsync, a vertical synchronous signal Vsync, and a clock signal CLK. The timing controlling part 140 generates the data start signal STH using the horizontal synchronous signal Hsync and outputs the data start signal STH to the data driving part 130. In addition, the timing controlling part 140 generates the gate start signal STV using the vertical synchronous signal Vsync and outputs the gate start signal STV to the gate driving part 120. In addition, the timing controlling part 140 generates the gate clock signal CPV1 and the data clock signal CPV2 using the clock signal CLK, outputs the gate clock signal CPV1 to the gate driving part 120, and outputs the data clock signal CPV2 to the data driving part 130.

The gamma voltage generating part 150 generates the gamma voltage GV and outputs the gamma voltage GV to the data driving part 130. The light source part 160 provides light L to the display panel 110. For example, the light source part 160 may include a light emitting diode (LED).

The viewer position determining part 170 determines a position of a viewer viewing the image of the display panel 110 and outputs the viewer position signal OPS to the data driving part 130. More specifically, the viewer position determining part 170 determines whether the position of the viewer is in a first area (e.g., less than a reference distance from the display panel 110) or a second area (e.g., not less than the reference distance from the display panel 110).

For example, the viewer position signal OPS may have a low level when the position of the viewer is in the first area, and the viewer position signal OPS may have a high level when the position of the viewer is in the second area. In another embodiment, the viewer position signal OPS may have the high level when the position of the viewer is in the first area, and the viewer position signal OPS may have the low level when the position of the viewer is in the second area. The viewer position determining part 170 may be attached to the display panel 110.

Figure 2:
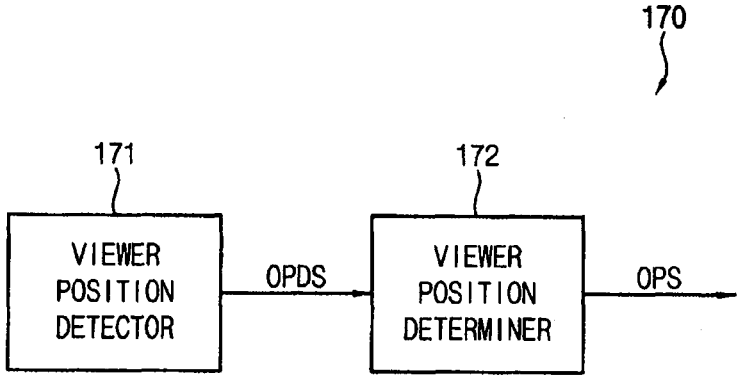
FIG. 2 is a block diagram illustrating a viewer position determining part of FIG. 1.

FIG. 2 is a block diagram illustrating the viewer position determining part 170 of FIG. 1.

Referring to FIGS. 1 and 2, the viewer position determining part 170 includes a viewer position detector 171 and a viewer position determiner 172. The viewer position detector 171 detects the position of the viewer and outputs the viewer position detection signal OPDS. The viewer position detector 171 may detect the position of the viewer by, for example, calculating a distance between eyes of the viewer after tracing the eyes of the viewer. In other embodiments, the viewer position detector 171 may detect the position of the viewer using infrared light or ultrasonic waves after tracing the eyes of the viewer. In some embodiments, the viewer position detector 171 may detect the position of the viewer using a camera.

Figure 3:
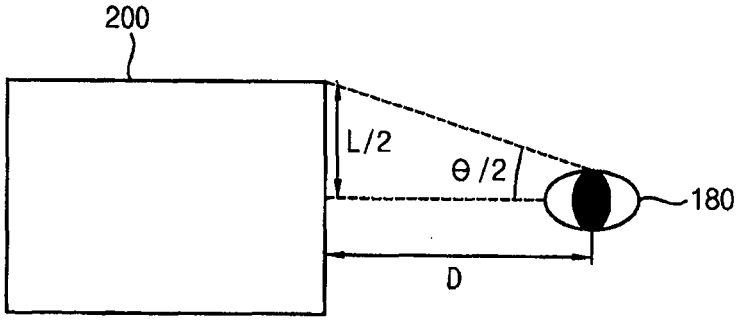
FIG. 3 is a plan view illustrating a unit pixel and eyes of a viewer, which supply points of reference for providing input parameters to an equation for determining a position of the viewer by a viewer position determiner of FIG. 2.

FIG. 3 is a plan view illustrating the unit pixel 200 and the eyes 180 of the viewer, which supply points of reference for providing input parameters to an equation for determining the position of the viewer by the viewer position determiner 172 of FIG. 2.

Referring to FIG. 3, a reference distance D from the unit pixel 200 to the eyes 180 of the viewer (e.g., the position of the viewer) may be calculated by using [Equation 1].

$$\tan(\theta/2)=(L/2)/D$$

$$D=(L/2)/\tan(\theta/2) \qquad \text{Equation 1}$$

Here, L denotes the pitch (e.g., height or width) of the unit pixel 200, while θ denotes the desired arc subtended by the pitch of the unit pixel 200 in the field of view of the eyes 180 of the viewer. θ may be determined, for example, through experimentation as would be apparent to one of ordinary skill. For example, θ may be chosen small enough that the eyes 180 of the viewer cannot discern changes in the resolution of the display panel 110 when the unit pixels 200 are driven by multiple gamma values versus being driven by only a single gamma value from the data driving part 130. For instance, θ may be chosen to be 1/60 of a degree, for which tan(θ/2) is about 0.00014544.

Referring to FIG. 2 again, the viewer position determiner 172 receives the viewer position detection signal OPDS, and determines whether the position of the viewer is in the first area (e.g., less than the reference distance D from the display panel 110) or in the second area (e.g., not less than the reference distance D from the display panel 110) to output the user position signal OPS. The reference distance D from the display panel 110 may be a boundary between the first area and the second area, and the second area may be an area where the viewer cannot recognize a change of resolution of the image.

Figure 4:
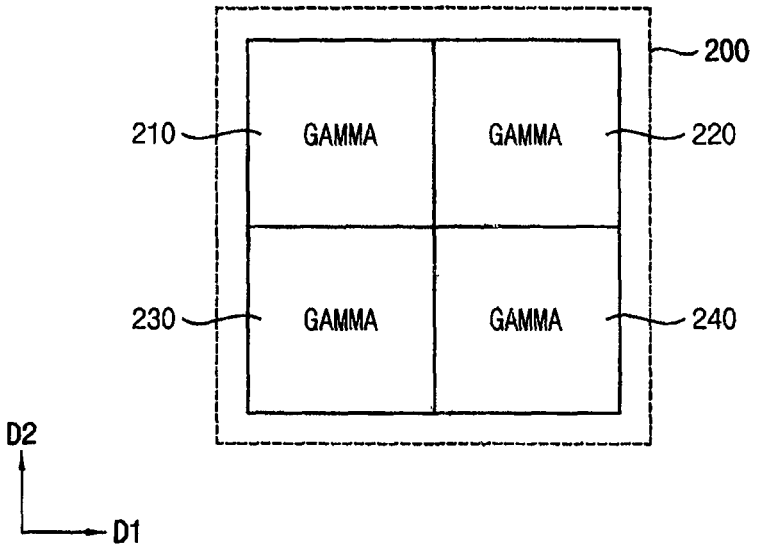
FIG. 4 is a plan view illustrating the unit pixel when the position of the viewer is in a first area (e.g., less than a reference distance from a display panel)
Figure 5:
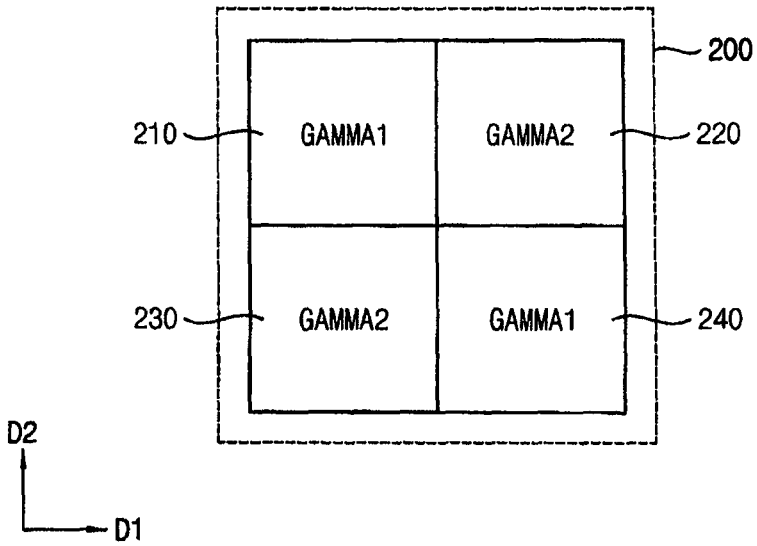
FIG. 5 is a plan view illustrating the unit pixel when the position of the viewer is in a second area (e.g., not less than the reference distance from the display panel)

FIG. 4 is a plan view illustrating the unit pixel 200 when the position of the viewer is in the first area (e.g., less than the reference distance D from the display panel 110), and the FIG. 5 is a plan view illustrating the unit pixel 200 when the position of the viewer is in the second area (e.g., not less than the reference distance D from the display panel 110).

Referring to FIGS. 1, 4, and 5, the unit pixel 200 may include a first sub pixel 210, a second sub pixel 220, a third sub pixel 230, and a fourth sub pixel 240. The second sub pixel 220 is disposed from the first sub pixel 210 in the first direction D1. The third sub pixel 230 is disposed from the first sub pixel 210 in the second direction D2. The fourth sub pixel 240 is disposed from the third sub pixel 230 in the first direction D1. Each of the first sub pixel 210, the second sub pixel 220, the third sub pixel 230, and the fourth sub pixel 240 may include one or more of a red pixel, a green pixel, and a blue pixel.

When the position of the viewer is in the first area, the unit pixel 200 is driven using a single gamma value GAMMA. More specifically, when the position of the viewer is in the first area, the first sub pixel 210, the second sub pixel 220, the third sub pixel 230, and the fourth sub pixel 240 are driven using the single gamma value GAMMA. The data driving part 130 may output a data signal DS having the single gamma value GAMMA to drive the first sub pixel 210, the second sub pixel 220, the third sub pixel 230, and the fourth sub pixel 240.

When the position of the viewer is in the second area, the unit pixel 200 is driven using a plurality of gamma values. More specifically, when the position of the viewer is in the second area, the first sub pixel 210 and the fourth sub pixel 240 are driven using a first gamma value GAMMA1, and the second sub pixel 220 and the third sub pixel 230 are driven using a second gamma value GAMMA2.

The data driving part 130 may output a data signal DS having the first gamma value GAMMA1 to drive the first sub pixel 210 and the fourth sub pixel 240, and may output a data signal DS having the second gamma value GAMMA2 to drive the second sub pixel 220 and the third sub pixel 230. The first gamma value GAMMA1 may be a white color gamma value, and the second gamma value GAMMA2 may be a black color gamma value. In another embodiment, the first gamma value GAMMA1 may be the black color gamma value, and the second gamma value GAMMA2 may be the white color gamma value.

[Chart 1] shows the reference distance D according to the resolution of the image data DATA and a size of the display panel 110 in the present embodiment.

CHART 1

| Resolution of image data (pixel) | Size of display panel (inch) | Pixel per inch (PPI) | Pitch of sub pixel (μm) | Resolution of image (pixel) | Pitch L of unit pixel (μm) | tan (θ/2) | Reference distance D (m) |
|---|---|---|---|---|---|---|---|
| 7680 * 3840 | 110 | 80 | 317 | 3840 * 1920 | 634 | 0.00014544 | 2.18 |
| 3840 * 2160 | 55 | 80 | 317 | 1920 * 1080 | 634 | 0.00014544 | 2.18 |
| 1920 * 1080 | 55 | 40 | 634 | 960 * 540 | 1268 | 0.00014544 | 4.36 |
| 1920 * 1080 | 60 | 37 | 692 | 960 * 540 | 1384 | 0.00014544 | 4.76 |

In [Chart 1], four different examples are shown, each for a display panel 110 including unit pixels 200 each having four sub pixels in a 2×2 configuration. Referring to [Chart 1] and FIG. 3, in the first example, the resolution of the image data DATA is 7680*3840 pixels (or sub pixels, as displayed on the display panel 110), the size of the display panel 110 is about 110 inches (e.g., the pixels per inch (PPI) is about 80 and the pitch of the sub pixel is about 317 μm), the resolution of the image displayed on the display panel 110 is about 3840*1920 (unit) pixels, the pitch of the unit pixel is about 634 μm, tan(θ/2) is about 0.00014544 (where θ is 1/60 of a degree), and the reference distance D is about 2.18 m because the unit pixel 200 includes four sub pixels 210, 220, 230, and 240 with two columns and two rows.

In the second example, the resolution of the image data DATA is 3840*2160 pixels, the size of the display panel 110 is about 55 inches (e.g., the pixels per inch (PPI) is about 80 and the pitch of the sub pixel is about 317 μm), the resolution of the image displayed on the display panel 110 is 1920*1080 pixels, the pitch of the unit pixel is about 634 μm, tan(θ/2) is about 0.00014544, and the reference distance D is about 2.18 m because the unit pixel 200 includes four sub pixels 210, 220, 230, and 240 with two columns and two rows.

In the third example, the resolution of the image data DATA is 1920*1080 pixels, the size of the display panel 110 is about 55 inches (e.g., the pixels per inch (PPI) is about 40 and the pitch of the sub pixel is about 634 μm), the resolution of the image displayed on the display panel 110 is 960*540 pixels, the pitch of the unit pixel is about 1268 μm, tan(θ/2) is about 0.00014544, and the reference distance D is about 4.36 m because the unit pixel 200 includes four sub pixels 210, 220, 230, and 240 with two columns and two rows.

In the fourth example, the resolution of the image data DATA is about 1920*1080 pixels, the size of the display panel 110 is about 60 inches (e.g., the pixels per inch (PPI) is about 37 and the pitch of the sub pixel is about 692 μm), the resolution of the image displayed on the display panel 110 is 960*540 pixels, the pitch of the unit pixel is about 1384 μm, tan(θ/2) is about 0.00014544, and the reference distance D is about 4.76 m because the unit pixel 200 includes four sub pixels 210, 220, 230, and 240 with two columns and two rows. In the above embodiments, the unit pixel 200 includes the four sub pixels 210, 220, 230, and 240, but the present invention is not limited thereto. For example, in other embodiments, the unit pixel 200 may include sixteen sub pixels disposed with four columns and four rows.

[Chart 2] shows the reference distance D according to the resolution of the image data DATA and the size of the display panel 110, when the unit pixel 200 includes 16 sub pixels.

CHART 2

| Resolution of image data (pixel) | Size of display panel (inch) | Pixel per inch (PPI) | Pitch of sub pixel (μm) | Resolution of image (pixel) | Pitch L of unit pixel (μm) | tan (θ/2) | Reference distance D (m) |
|---|---|---|---|---|---|---|---|
| 7680 * 3840 | 110 | 80 | 317 | 1920 * 960 | 1268 | 0.00014544 | 4.36 |
| 3840 * 2160 | 55 | 80 | 317 | 960 * 480 | 1268 | 0.00014544 | 4.36 |

In [Chart 2], two different examples are shown, each for a display panel 110 including unit pixels 200 each having sixteen sub pixels in a 4×4 configuration. Referring to [Chart 2] and FIG. 3, in the first example, the resolution of the image data DATA is 7680*3840 pixels, the size of the display panel 110 is about 110 inches (e.g., the pixel per inch (PPI) is about 80 and the pitch of the sub pixel is about 317 μm), the resolution of the image displayed on the display panel 110 is about 1920*960 pixels, the pitch of the unit pixel is about 1268 μm, tan(θ/2) is about 0.00014544, and the reference distance D is about 4.36 m because the unit pixel 200 includes 16 sub pixels with 4 columns and 4 rows.

In the second example, the resolution of the image data DATA is 3840*2160 pixels, the size of the display panel 110 is about 55 inches (e.g., the pixel per inch (PPI) is about 80 and the pitch of the sub pixel is about 317 μm), the resolution of the image displayed on the display panel 110 is 960*480 pixels, the pitch of the unit pixel is about 1268 μm, tan(θ/2) is about 0.00014544, and the reference distance D is about 4.36 m because the unit pixel 200 includes 16 sub pixels with 4 columns and 4 rows.

Figure 6:
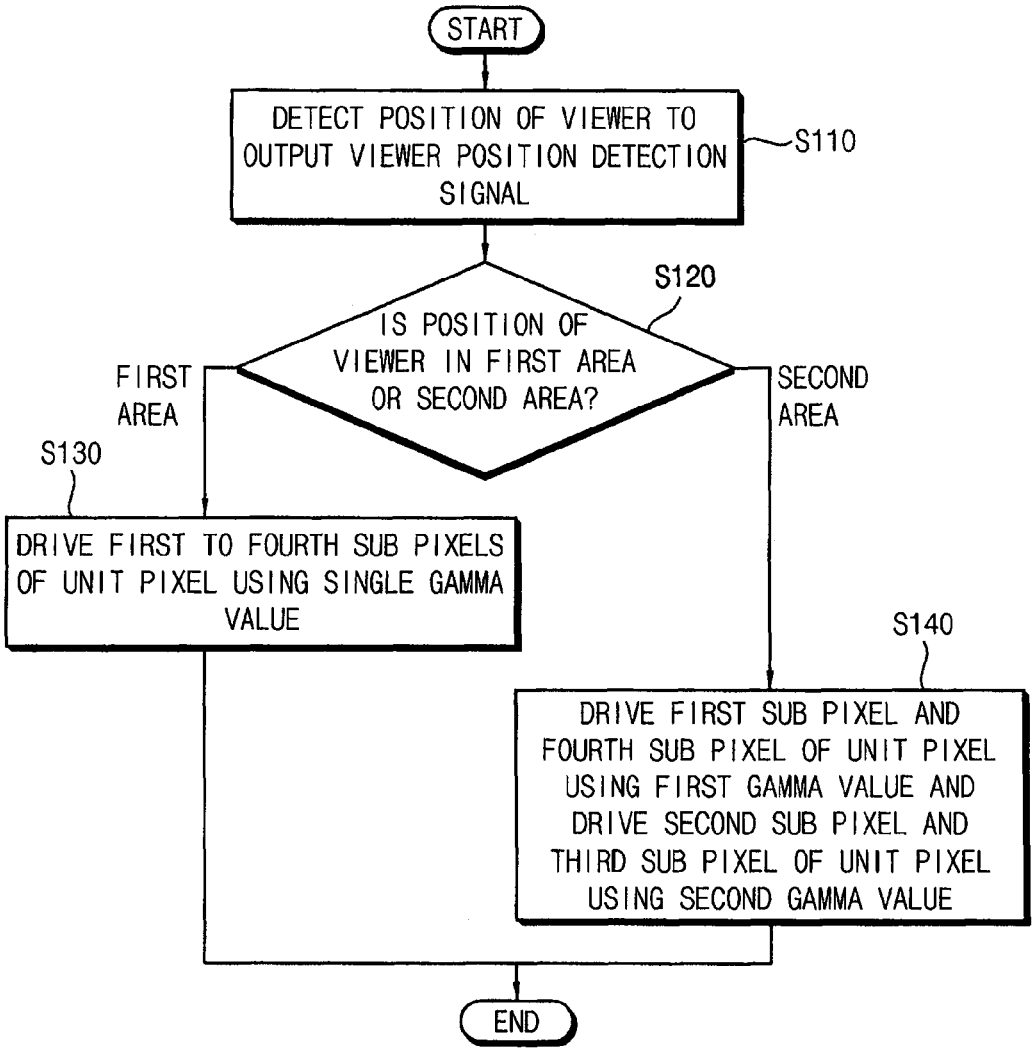
FIG. 6 is a flow chart illustrating a method of driving a display panel performed by a display panel driving apparatus of FIG. 1 driving the unit pixel of FIGS. 4 and 5.

FIG. 6 is a flow chart illustrating a method of driving a display panel 110 performed by the display panel driving apparatus 101 of FIG. 1 driving the unit pixel 200 of FIGS. 4 and 5.

Referring to FIGS. 1 to 6, the position of the viewer is detected and the viewer position detection signal OPDS is outputted (step S110). More specifically, the viewer position detector 171 of the viewer position determining part 170 calculates the distance D between the unit pixel 200 and the eyes 180 of the viewer.

In step S120, it is determined whether the position of the viewer is in the first area or the second area. More specifically, the viewer position determiner 172 of the viewer position determining part 170 receives the viewer position detection signal OPDS, and determines whether the position of the viewer is in the first area (e.g., less than the reference distance D from the display panel 110) or in the second area (e.g., not less than the reference distance D from the display panel 110) to output the user position signal OPS. For example, the reference distance D may be calculated from [Equation 1] as described above.

When the position of the viewer is in the first area, the first sub pixel 210, the second sub pixel 220, the third sub pixel 230, and the fourth sub pixel 240 are driven using the single gamma value GAMMA (step S130). For example, the data driving part 130 may output the data signal DS having the single gamma value GAMMA to drive the first sub pixel 210, the second sub pixel 220, the third sub pixel 230, and the fourth sub pixel 240.

In step S140, when the position of the viewer is in the second area, the first sub pixel 210 and the fourth sub pixel 240 are driven using the first gamma value GAMMA1, and the second sub pixel 220 and the third sub pixel 230 are driven using the second gamma value GAMMA2. For example, the data driving part 130 may output the data signal DS having the first gamma value GAMMA1 to drive the first sub pixel 210 and the fourth sub pixel 240, and may output the data signal DS having the second gamma value GAMMA2 to drive the second sub pixel 220 and the third sub pixel 230.

Generally, a front gamma characteristic of the display panel 110 and a side gamma characteristic are different. More specifically, a front gamma curve denoting the front gamma characteristic and a side gamma curve denoting the side gamma characteristic are different, where the difference between a front gamma value and a side gamma value increases as a gamma value is far away from the white color gamma value or the black color gamma value. Further, the difference between the front gamma value and the side gamma value decreases as the gamma value is close to the white color gamma value or the black color gamma value.

According to embodiments of the present invention, the unit pixel 200 is driven (e.g., selectively driven) using the first gamma value GAMMA1 and the second gamma value GAMMA2 and therefore, side visibility of the display apparatus 100 may be improved. In addition, when the viewer is in the first area where the viewer may recognize the change of the resolution of the image, the unit pixel 200 is driven using the single gamma value GAMMA and therefore, a decrease of the resolution of the image displayed on the display panel 110 may be reduced or prevented.

Figure 7:
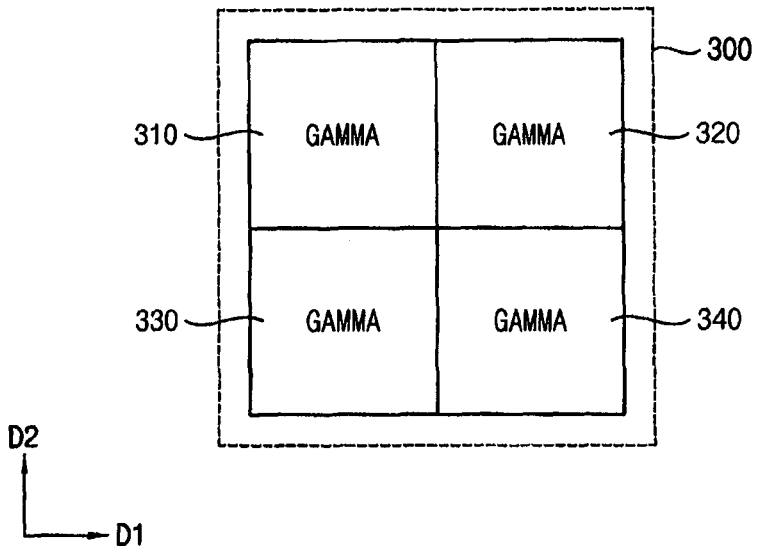
FIG. 7 is a plan view illustrating a unit pixel when a position of a viewer is in a first area (e.g., less than a reference distance from a display panel), according to an embodiment of the present invention.
Figure 8:
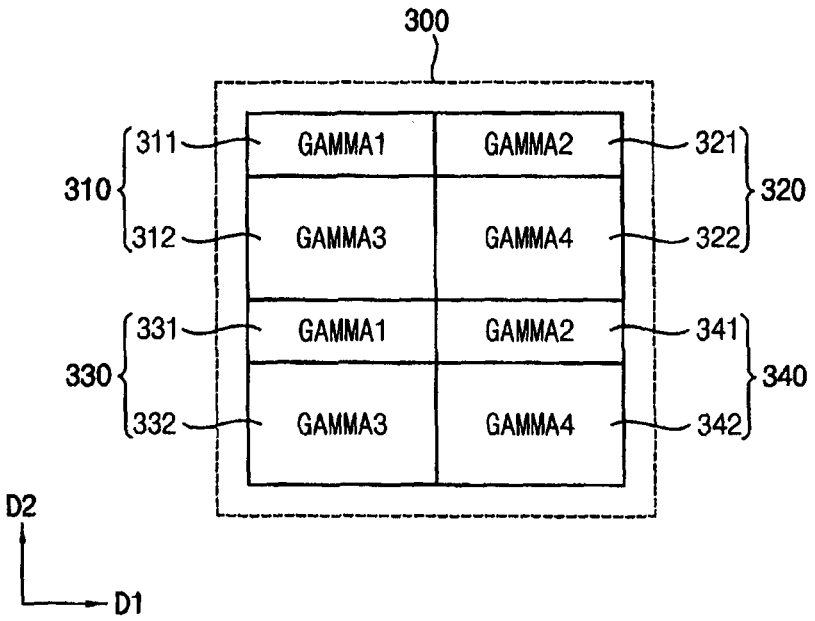
FIG. 8 is a plan view illustrating the unit pixel when the position of the viewer is in a second area (e.g., not less than the reference distance from the display panel), according to an embodiment of the present invention.

FIG. 7 is a plan view illustrating a unit pixel 300 when a position of a viewer is in a first area (e.g., less than a reference distance D from a display panel 110), and FIG. 8 is a plan view illustrating the unit pixel 300 when the position of the viewer is in a second area (e.g., not less than the reference distance D from the display panel 110), according to an embodiment of the present invention.

The unit pixel 300 may be included in the display panel 110 of the display apparatus 100 illustrated in FIG. 1, and may be driven by the display panel driving apparatus 101 of FIG. 1. Referring to FIGS. 1, 7, and 8, the unit pixel 300 may include a first sub pixel 310, a second sub pixel 320, a third sub pixel 330, and a fourth sub pixel 340. The second sub pixel 320 is disposed from the first sub pixel 310 in a first direction D1. The third sub pixel 330 is disposed from the first sub pixel 310 in a second direction D2 substantially perpendicular to the first direction D1. The fourth sub pixel 340 is disposed from the third sub pixel 330 in the first direction D1. Each of the first sub pixel 310, the second sub pixel 320, the third sub pixel 330, and the fourth sub pixel 340 may include one or more of a red pixel, a green pixel, and a blue pixel.

When the position of the viewer is in the first area, the unit pixel 300 is driven using a single gamma value GAMMA. More specifically, when the position of the viewer is in the first area, the first sub pixel 310, the second sub pixel 320, the third sub pixel 330, and the fourth sub pixel 340 are driven using the single gamma value GAMMA. The data driving part 130 of FIG. 1 may output a data signal DS having the single gamma value GAMMA to drive the first sub pixel 310, the second sub pixel 320, the third sub pixel 330, and the fourth sub pixel 340.

When the position of the viewer is in the second area, the unit pixel 300 is driven using a plurality of gamma values. More specifically, when the position of the viewer is in the second area, the first sub pixel 310 is driven using a first gamma value GAMMA1 and a third gamma value GAMMA3, the second sub pixel 320 is driven using a second gamma value GAMMA2 and a fourth gamma value GAMMA4, the third sub pixel 330 is driven using the first gamma value GAMMA1 and the third gamma value GAMMA3, and the fourth sub pixel 340 is driven using the second gamma value GAMMA2 and the fourth gamma value GAMMA4.

The data driving part 130 of FIG. 1 may output a data signal DS having the first gamma value GAMMA1 and a data signal DS having the third gamma value GAMMA3 to drive the first sub pixel 310, may output a data signal DS having the second gamma value GAMMA2 and a data signal DS having the fourth gamma value GAMMA4 to drive the second sub pixel 320, may output the data signal DS having the first gamma value GAMMA1 and the data signal DS having the third gamma value GAMMA3 to drive the third sub pixel 330, and may output the data signal DS having the second gamma value GAMMA2 and the data signal DS having the fourth gamma value GAMMA4 to drive the fourth sub pixel 340.

The first sub pixel 310 may include a first portion 311 and a second portion 312. The data signal DS having the first gamma value GAMMA1 may be applied to the first portion 311 of the first sub pixel 310, and the data signal DS having the third gamma value GAMMA3 may be applied to the second portion 312 of the first sub pixel 310. The second sub pixel 320 may include a first portion 321 and a second portion 322. The data signal DS having the second gamma value GAMMA2 may be applied to the first portion 321 of the second sub pixel 320, and the data signal DS having the fourth gamma value GAMMA4 may be applied to the second portion 322 of the second sub pixel 320.

The third sub pixel 330 may include a first portion 331 and a second portion 332. The data signal DS having the first gamma value GAMMA1 may be applied to the first portion 331 of the third sub pixel 330, and the data signal DS having the third gamma value GAMMA3 may be applied to the second portion 332 of the third sub pixel 330. The fourth sub pixel 340 may include a first portion 341 and a second portion 342. The data signal DS having the second gamma value GAMMA2 may be applied to the first portion 341 of the fourth sub pixel 340, and the data signal DS having the fourth gamma value GAMMA4 may be applied to the second portion 342 of the fourth sub pixel 340.

The first gamma value GAMMA1 may be a white color gamma value, the third gamma value GAMMA3 may be a black color gamma value, and the second gamma value GAMMA2 and the fourth gamma value GAMMA4 may be between the first gamma value GAMMA1 and the third gamma value GAMMA3.

The position of the viewer may be determined by the viewer position determining part 170 of FIG. 1. In addition, the reference distance D defining the first area and the second area may be calculated based on [Chart 1] and [Chart 2], or by using [Equation 1] with appropriate values for the unit pixel pitch L and pitch angle θ. In addition, the second area may be defined as an area where the viewer may not recognize a change of resolution of an image (such as unit pixel pitch angle θ being ‰ of a degree or less).

Figure 9:
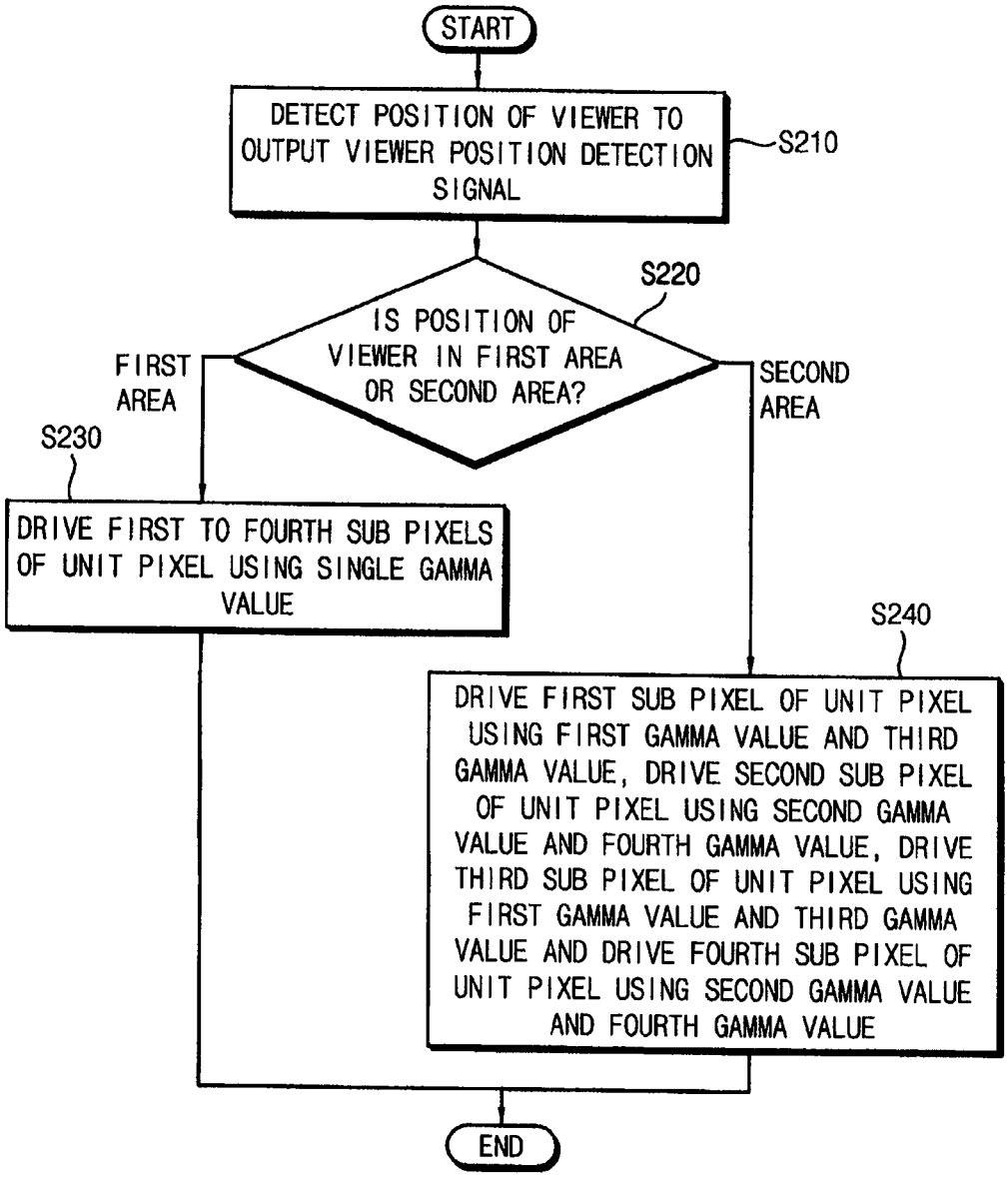
FIG. 9 is a flow chart illustrating a method of driving a display panel performed by the display panel driving apparatus of FIG. 1 driving the unit pixel of FIGS. 7 and 8.

FIG. 9 is a flow chart illustrating a method of driving a display panel 110 performed by the display panel driving apparatus 101 of FIG. 1 driving the unit pixel 300 of FIGS. 7 and 8.

Referring to FIGS. 1, 2, and 7 to 9, the position of the viewer is detected and the viewer position detection signal OPDS is outputted (step S210). More specifically, the viewer position detector 171 of the viewer position determining part 170 in FIG. 2 calculates the distance D between the unit pixel 300 and the eyes 180 of the viewer.

In step S220, it is determined whether the position of the viewer is in the first area or the second area. More specifically, the viewer position determiner 172 of the viewer position determining part 170 in FIG. 2 receives the viewer position detection signal OPDS, and determines whether the position of the viewer is in the first area (e.g., less than the reference distance D from the display panel 110) or in the second area (e.g., not less than the reference distance D from the display panel 110) to output the user position signal OPS.

When the position of the viewer is in the first area, the first sub pixel 310, the second sub pixel 320, the third sub pixel 330, and the fourth sub pixel 340 are driven using the single gamma value GAMMA (step S230). For example, the data driving part 130 of FIG. 1 may output the data signal DS having the single gamma value GAMMA to drive the first sub pixel 310, the second sub pixel 320, the third sub pixel 330, and the fourth sub pixel 340.

When the position of the viewer is in the second area, the first sub pixel 310 is driven using the first gamma value GAMMA1 and the third gamma value GAMMA3, the second sub pixel 320 is driven using the second gamma value GAMMA2 and the fourth gamma value GAMMA4, the third sub pixel 330 is driven using the first gamma value GAMMA1 and the third gamma value GAMMA3, and the fourth sub pixel 340 is driven using the second gamma value GAMMA2 and the fourth gamma value GAMMA4 (step S240).

For example, the data driving part 130 of FIG. 1 may output the data signal DS having the first gamma value GAMMA1 and the data signal DS having the third gamma value GAMMA3 to drive the first sub pixel 310, may output the data signal DS having the second gamma value GAMMA2 and the data signal DS having the fourth gamma value GAMMA4 to drive the second sub pixel 320, may output the data signal DS having the first gamma value GAMMA1 and the data signal DS having the third gamma value GAMMA3 to drive the third sub pixel 330, and may output the data signal DS having the second gamma value GAMMA2 and the data signal DS having the fourth gamma value GAMMA4 to drive the fourth sub pixel 340.

According to the present embodiment, the unit pixel 300 is driven using the first to fourth gamma values GAMMA1, GAMMA2, GAMMA3, and GAMMA4 and therefore, side visibility of the display apparatus 100 may be improved. In addition, when the viewer is in the first area where the viewer may recognize the change of the resolution of the image, the unit pixel 300 is driven using the single gamma value GAMMA and therefore, a decrease of the resolution of the image displayed on the display panel 110 may be reduced or prevented.

Figure 10:
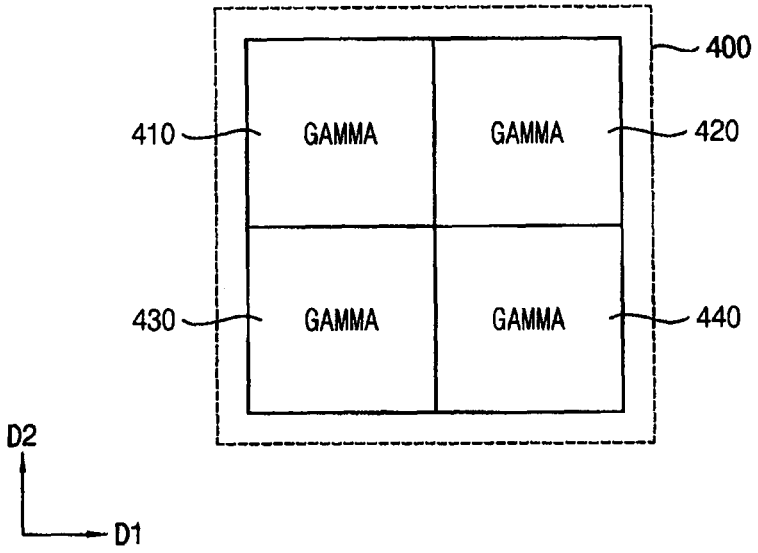
FIG. 10 is a plan view illustrating a unit pixel when a position of a viewer is in a first area (e.g., less than a reference distance from a display panel), according to an embodiment of the present invention.
Figure 11:
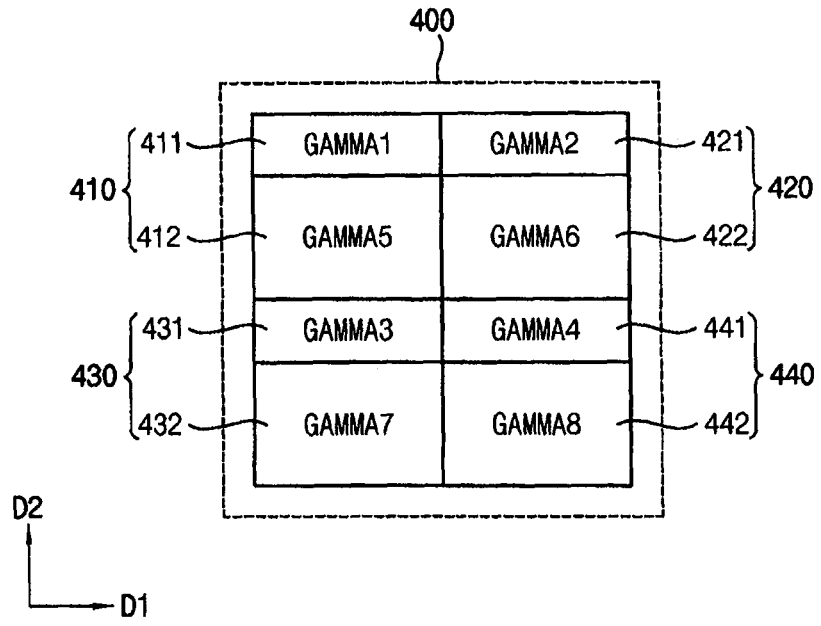
FIG. 11 is a plan view illustrating the unit pixel when the position of the viewer is in a second area (e.g., not less than the reference distance from the display panel), according to an embodiment of the present invention.

FIG. 10 is a plan view illustrating a unit pixel 400 when a position of a viewer is in a first area (e.g., less than a reference distance D from a display panel 110), and FIG. 11 is a plan view illustrating the unit pixel 400 when the position of the viewer is in a second area (e.g., not less than the reference distance D from the display panel 110), according to an embodiment of the present invention.

The unit pixel 400 may be included in the display panel 110 of the display apparatus 100 illustrated in FIG. 1, and may be driven by the display panel driving apparatus 101 of FIG. 1. Referring to FIGS. 1, 10, and 11, the unit pixel 400 may include a first sub pixel 410, a second sub pixel 420, a third sub pixel 430, and a fourth sub pixel 440. The second sub pixel 420 is disposed from the first sub pixel 410 in a first direction D1. The third sub pixel 430 is disposed from the first sub pixel 410 in a second direction D2 substantially perpendicular to the first direction D1. The fourth sub pixel 440 is disposed from the third sub pixel 430 in the first direction D1. Each of the first sub pixel 410, the second sub pixel 420, the third sub pixel 430, and the fourth sub pixel 440 may include one or more of a red pixel, a green pixel, and a blue pixel.

When the position of the viewer is in the first area, the unit pixel 400 is driven using a single gamma value GAMMA. More specifically, when the position of the viewer is in the first area, the first sub pixel 410, the second sub pixel 420, the third sub pixel 430, and the fourth sub pixel 440 are driven using the single gamma value GAMMA. The data driving part 130 of FIG. 1 may output a data signal DS having the single gamma value GAMMA to drive the first sub pixel 410, the second sub pixel 420, the third sub pixel 430, and the fourth sub pixel 440.

When the position of the viewer is in the second area, the unit pixel 400 is driven using a plurality of gamma values. More specifically, when the position of the viewer is in the second area, the first sub pixel 410 is driven using a first gamma value GAMMA1 and a fifth gamma value GAMMA5, the second sub pixel 420 is driven using a second gamma value GAMMA2 and a sixth gamma value GAMMA6, the third sub pixel 430 is driven using a third gamma value GAMMA3 and a seventh gamma value GAMMA7, and the fourth sub pixel 440 is driven using a fourth gamma value GAMMA4 and an eighth gamma value GAMMA8.

The data driving part 130 of FIG. 1 may output a data signal DS having the first gamma value GAMMA1 and a data signal DS having the fifth gamma value GAMMA5 to drive the first sub pixel 410, may output a data signal DS having the second gamma value GAMMA2 and a data signal DS having the sixth gamma value GAMMA6 to drive the second sub pixel 420, may output a data signal DS having the third gamma value GAMMA3 and a data signal DS having the seventh gamma value GAMMA7 to drive the third sub pixel 430, and may output a data signal DS having the fourth gamma value GAMMA4 and a data signal DS having the eighth gamma value GAMMA8 to drive the fourth sub pixel 440.

The first sub pixel 410 may include a first portion 411 and a second portion 412. The data signal DS having the first gamma value GAMMA1 may be applied to the first portion 411 of the first sub pixel 410, and the data signal DS having the fifth gamma value GAMMA5 may be applied to the second portion 412 of the first sub pixel 410. The second sub pixel 420 may include a first portion 421 and a second portion 422. The data signal DS having the second gamma value GAMMA2 may be applied to the first portion 421 of the second sub pixel 420, and the data signal DS having the sixth gamma value GAMMA6 may be applied to the second portion 422 of the second sub pixel 420.

The third sub pixel 430 may include a first portion 431 and a second portion 432. The data signal DS having the third gamma value GAMMA3 may be applied to the first portion 431 of the third sub pixel 430, and the data signal DS having the seventh gamma value GAMMA7 may be applied to the second portion 432 of the third sub pixel 430. The fourth sub pixel 440 may include a first portion 441 and a second portion 442. The data signal DS having the fourth gamma value GAMMA4 may be applied to the first portion 441 of the fourth sub pixel 440, and the data signal DS having the eighth gamma value GAMMA8 may be applied to the second portion 442 of the fourth sub pixel 440.

The fifth gamma value GAMMA5 may be less than the first gamma value GAMMA1, the sixth gamma value GAMMA6 may be less than the second gamma value GAMMA2, the seventh gamma value GAMMA7 may be less than the third gamma value GAMMA3, and the eighth gamma value GAMMA8 may be less than the fourth gamma value GAMMA4. Thus, the fifth gamma value GAMMA5 may be determined according to the first gamma value GAMMA1, the sixth gamma value GAMMA6 may be determined according to the second gamma value GAMMA2, the seventh gamma value GAMMA7 may be determined according to the third gamma value GAMMA3, and the eighth gamma value GAMMA8 may be determined according to the fourth gamma value GAMMA4.

The first gamma value GAMMA1 may be a white color gamma value, the seventh gamma value GAMMA7 may be a black color gamma value, and the second gamma value GAMMA2, the third gamma value GAMMA3, and the fourth gamma value GAMMA4 may be between the first gamma value GAMMA1 and the seventh gamma value GAMMA7.

Figure 12:
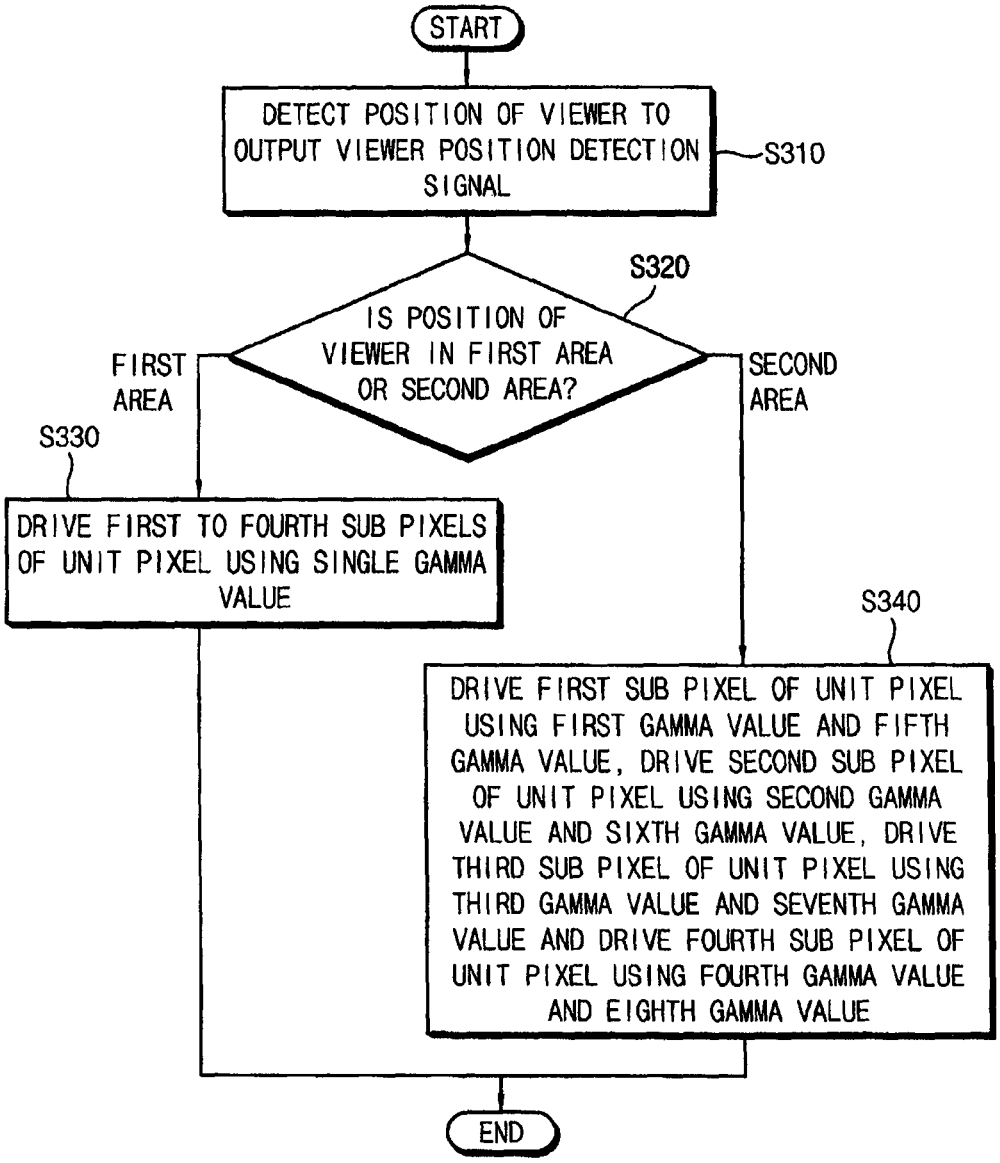
FIG. 12 is a flow chart illustrating a method of driving a display panel performed by the display panel driving apparatus of FIG. 1 driving the unit pixel of FIGS. 10 and 11.

FIG. 12 is a flow chart illustrating a method of driving a display panel 110 performed by the display panel driving apparatus 101 of FIG. 1 driving the unit pixel 400 of FIGS. 10 and 11.

Referring to FIGS. 1, 2, and 10 to 12, the position of the viewer is detected and the viewer position detection signal OPDS is outputted (step S310). More specifically, the viewer position detector 171 of the viewer position determining part 170 in FIG. 2 calculates the distance D between the unit pixel 400 and the eyes 180 of the viewer.

In step S320, it is determined whether the position of the viewer is in the first area or the second area. More specifically, the viewer position determiner 172 of the viewer position determining part 170 in FIG. 2 receives the viewer position detection signal OPDS, and determines whether the position of the viewer is in the first area (e.g., less than the reference distance D from the display panel 110) or in the second area (e.g., not less than the reference distance D from the display panel 110) to output the user position signal OPS.

When the position of the viewer is in the first area, the first sub pixel 410, the second sub pixel 420, the third sub pixel 430, and the fourth sub pixel 440 are driven using the single gamma value GAMMA (step S330). For example, the data driving part 130 of FIG. 1 may output the data signal DS having the single gamma value GAMMA to drive the first sub pixel 410, the second sub pixel 420, the third sub pixel 430, and the fourth sub pixel 440.

When the position of the viewer is in the second area, the first sub pixel 410 is driven using the first gamma value GAMMA1 and the fifth gamma value GAMMA5, the second sub pixel 420 is driven using the second gamma value GAMMA2 and the sixth gamma value GAMMA6, the third sub pixel 430 is driven using the third gamma value GAMMA3 and the seventh gamma value GAMMA7, and the fourth sub pixel 440 is driven using the fourth gamma value GAMMA4 and the eighth gamma value GAMMA8 (step S340).

For example, the data driving part 130 of FIG. 1 may output the data signal DS having the first gamma value GAMMA1 and the data signal DS having the fifth gamma value GAMMA5 to drive the first sub pixel 410, may output the data signal DS having the second gamma value GAMMA2 and the data signal DS having the sixth gamma value GAMMA6 to drive the second sub pixel 420, may output the data signal DS having the third gamma value GAMMA3 and the data signal DS having the seventh gamma value GAMMA7 to drive the third sub pixel 430, and may output the data signal DS having the fourth gamma value GAMMA4 and the data signal DS having the eighth gamma value GAMMA8 to drive the fourth sub pixel 440.

According to the present embodiment, the unit pixel 400 is driven using the first to eighth gamma values GAMMA1, GAMMA2, . . . , and GAMMA8 and therefore, side visibility of the display apparatus 100 may be improved. In addition, when the viewer is in the first area where the viewer may recognize a change of resolution of an image, the unit pixel 400 is driven using the single gamma value GAMMA and therefore, a decrease of the resolution of the image displayed on the display panel 110 may be reduced or prevented.

Figure 13:
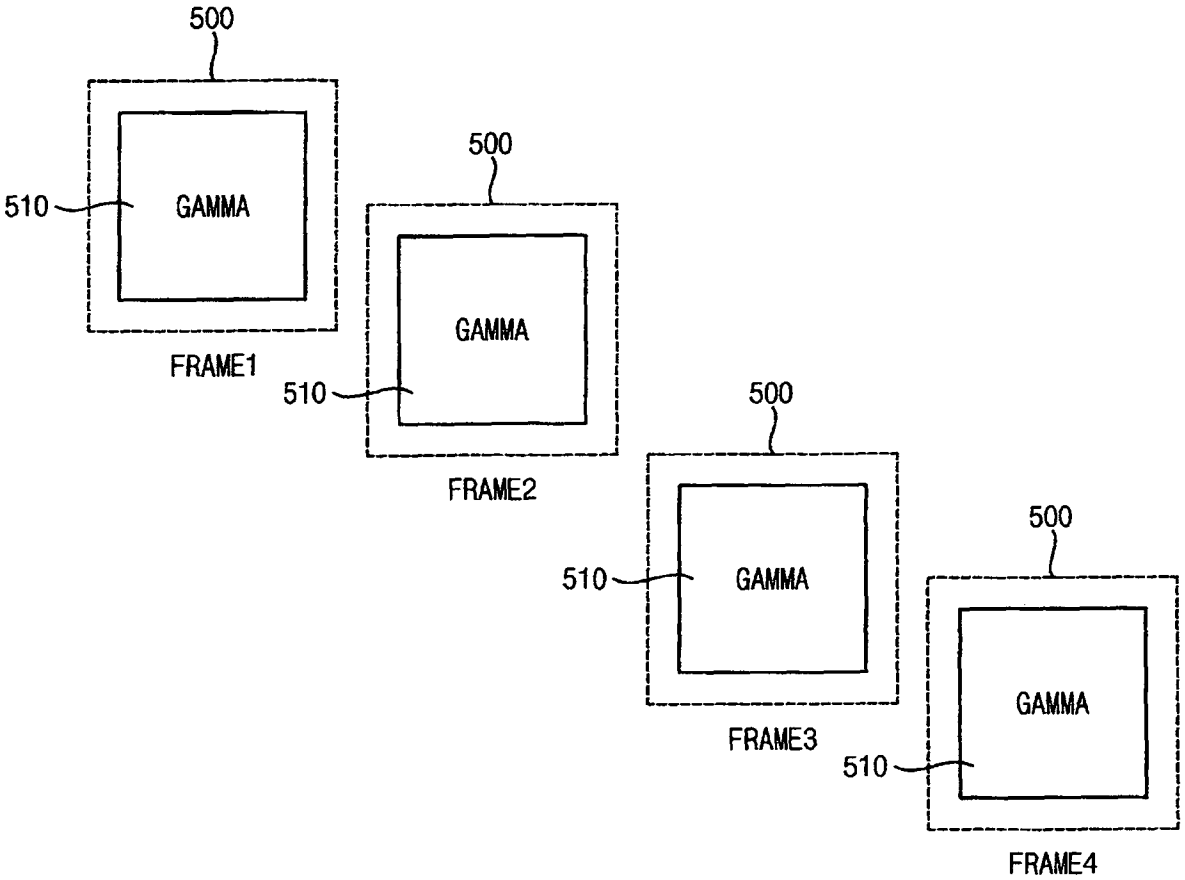
FIG. 13 is a plan view illustrating a unit pixel when a position of a viewer is in a first area (e.g., less than a reference distance from a display panel), according to an embodiment of the present invention.
Figure 14:
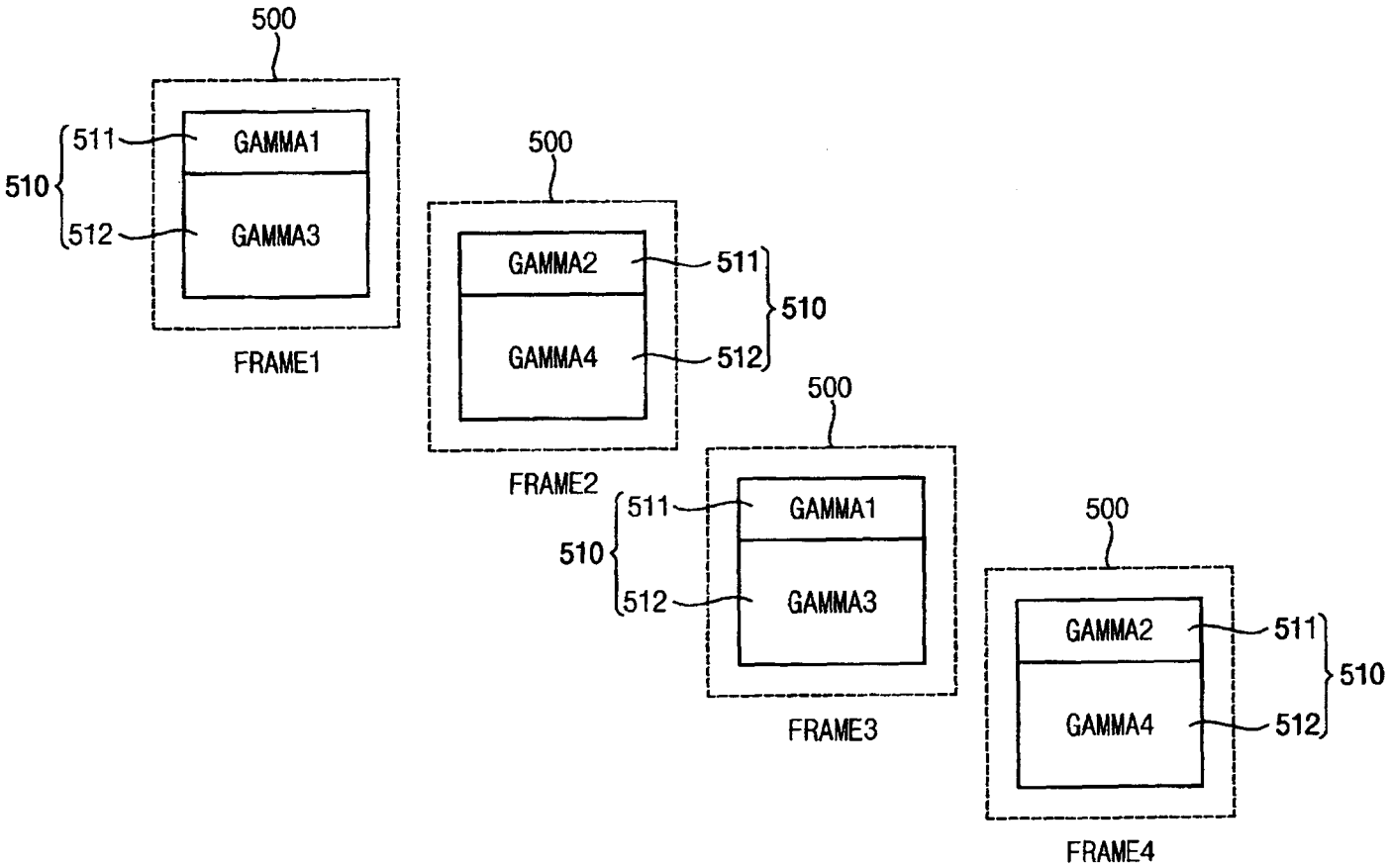
FIG. 14 is a plan view illustrating the unit pixel when the position of the viewer is in a second area (e.g., not less than the reference distance from the display panel), according to an embodiment of the present invention.

FIG. 13 is a plan view illustrating a unit pixel 500 when a position of a viewer is in a first area (e.g., less than a reference distance D from a display panel 110), and FIG. 14 is a plan view illustrating the unit pixel 500 when the position of the viewer is in a second area (e.g., not less than the reference distance D from the display panel 110), according to an embodiment of the present invention.

The unit pixel 500 may be included in the display panel 110 of the display apparatus 100 illustrated in FIG. 1, and may be driven by the display panel driving apparatus 101 of FIG. 1. Referring to FIGS. 1, 13, and 14, the unit pixel 500 may include a first sub pixel 510.

When the position of the viewer is in the first area, the unit pixel 500 is driven using a single gamma value GAMMA. More specifically, the unit pixel 500 is driven using the single gamma value GAMMA during each of frames. For example, the unit pixel 500 may be driven using the single gamma value GAMMA during a first frame FRAME1, the unit pixel 500 may be driven using the single gamma value GAMMA during a second frame FRAME2, the unit pixel 500 may be driven using the single gamma value GAMMA during a third frame FRAME3, and the unit pixel 500 may be driven using the single gamma value GAMMA during a fourth frame FRAME4. The data driving part 130 of FIG. 1 may output a data signal DS having the single gamma value GAMMA during the first to fourth frames FRAME1, FRAME2, FRAME3, and FRAME4 to drive the unit pixel 500.

When the position of the viewer is in the second area, the unit pixel 500 is driven using a plurality of gamma values. More specifically, when the position of the viewer is in the second area, the unit pixel 500 is driven using a first gamma value GAMMA1 and a third gamma value GAMMA3 during odd-numbered frames, and the unit pixel 500 is driven using a second gamma value GAMMA2 and a fourth gamma value GAMMA4 during even-numbered frames.

For example, the unit pixel 500 may be driven using the first gamma value GAMMA1 and the third gamma value GAMMA3 during the first frame FRAME1, the unit pixel 500 may be driven using the second gamma value GAMMA2 and the fourth gamma value GAMMA4 during the second frame FRAME2, the unit pixel 500 may be driven using the first gamma value GAMMA1 and the third gamma value GAMMA3 during the third frame FRAME3, and the unit pixel 500 may be driven using the second gamma value GAMMA2 and the fourth gamma value GAMMA4 during the fourth frame FRAME4.

The data driving part 130 of FIG. 1 may output a data signal DS having the first gamma value GAMMA1 and a data signal DS having the third gamma value GAMMA3 during the odd-numbered frames to drive the unit pixel 500, and may output a data signal DS having the second gamma value GAMMA2 and a data signal DS having the fourth gamma value GAMMA4 during the even-numbered frames to drive the unit pixel 500.

The first sub pixel 510 of the unit pixel 500 may include a first portion 511 and a second portion 512. The data signal DS having the first gamma value GAMMA1 may be applied to the first portion 511 of the first sub pixel 510 and the data signal DS having the third gamma value GAMMA3 may be applied to the second portion 512 of the first sub pixel 510 during the odd-numbered frames. The data signal DS having the second gamma value GAMMA2 may be applied to the first portion 511 of the first sub pixel 510 and the data signal DS having the fourth gamma value GAMMA4 may be applied to the second portion 512 of the first sub pixel 510 during the even-numbered frames.

Figure 15:
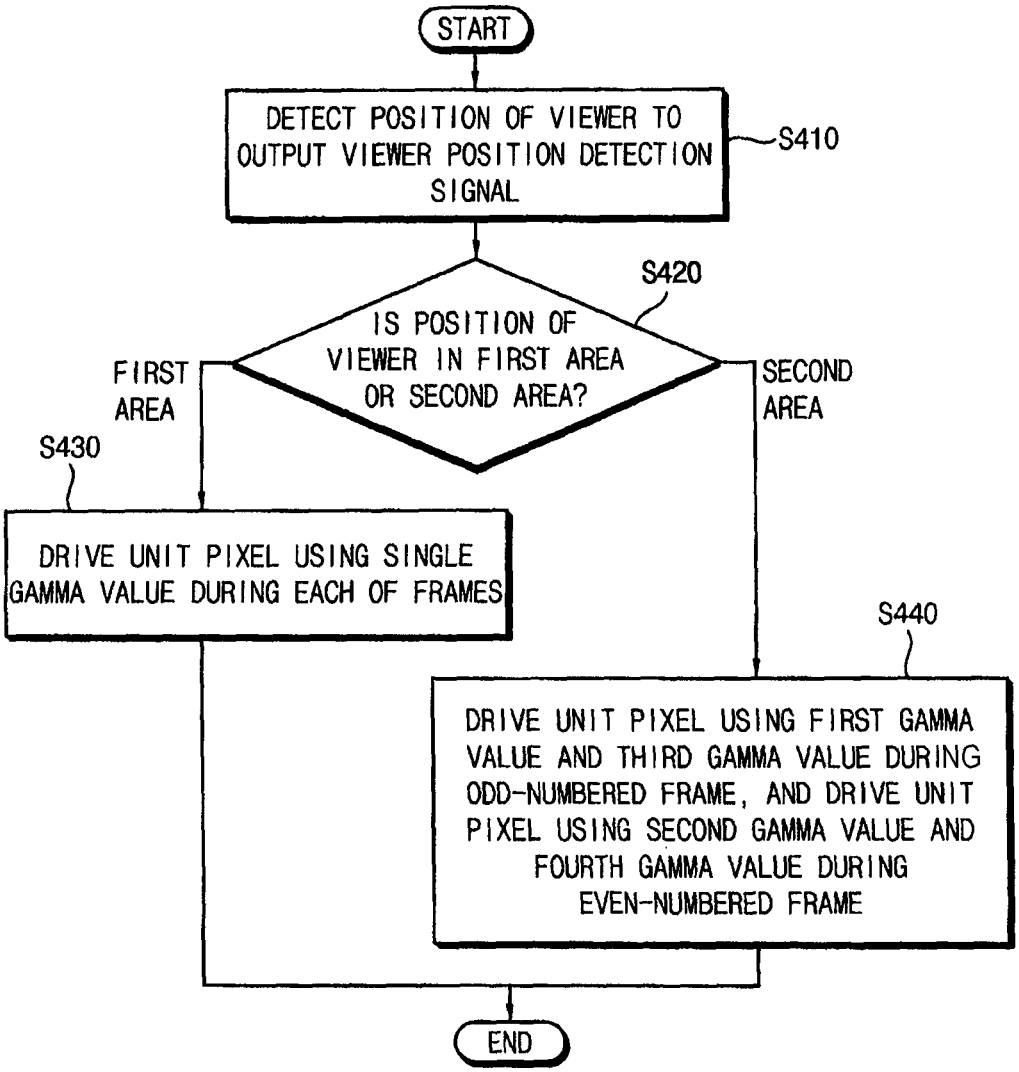
FIG. 15 is a flow chart illustrating a method of driving a display panel performed by the display panel driving apparatus of FIG. 1 driving the unit pixel of FIGS. 13 and 14.

FIG. 15 is a flow chart illustrating a method of driving a display panel 110 performed by the display panel driving apparatus 101 of FIG. 1 driving the unit pixel 500 of FIGS. 13 and 14.

Referring to FIGS. 1, 2, and 13 to 15, the position of the viewer is detected and the viewer position detection signal OPDS is outputted (step S410). More specifically, the viewer position detector 171 of the viewer position determining part 170 in FIG. 2 calculates the distance D between the unit pixel 500 and the eyes 180 of the viewer.

In step S420, it is determined whether the position of the viewer is in the first area or the second area. More specifically, the viewer position determiner 172 of the viewer position determining part 170 in FIG. 2 receives the viewer position detection signal OPDS, and determines whether the position of the viewer is in the first area (e.g., less than the reference distance D from the display panel 110) or in the second area (e.g., not less than the reference distance D from the display panel 110) to output the user position signal OPS.

When the position of the viewer is in the first area, the unit pixel 500 is driven using the single gamma value GAMMA during each of the frames (step S430). For example, the data driving part 130 of FIG. 1 may output the data signal DS having the single gamma value GAMMA during each of the frames to drive the unit pixel 500.

In step S440, when the position of the viewer is in the second area, the unit pixel 500 is driven using the first gamma value GAMMA1 and the third gamma value GAMMA3 during the odd-numbered frames, and the unit pixel 500 is driven using the second gamma value GAMMA2 and the fourth gamma value GAMMA4 during the even-numbered frames. For example, the data driving part 130 of FIG. 1 may output the data signal DS having the first gamma value GAMMA1 and the data signal DS having the third gamma value GAMMA3 during the odd-numbered frames to drive the unit pixel 500, may output the data signal DS having the second gamma value GAMMA2 and the data signal DS having the fourth gamma value GAMMA4 during the even-numbered frames to drive the unit pixel 500.

According to the present embodiment, the unit pixel 500 is driven using the first to fourth gamma values GAMMA1, GAMMA2, GAMMA3, and GAMMA4 and therefore, side visibility of the display apparatus 100 may be improved. In addition, when the viewer is in the first area where the viewer may recognize a change of resolution of an image, the unit pixel 500 is driven using the single gamma value GAMMA and therefore, a decrease of the resolution of the image displayed on the display panel 110 may be reduced or prevented.

Figure 16:
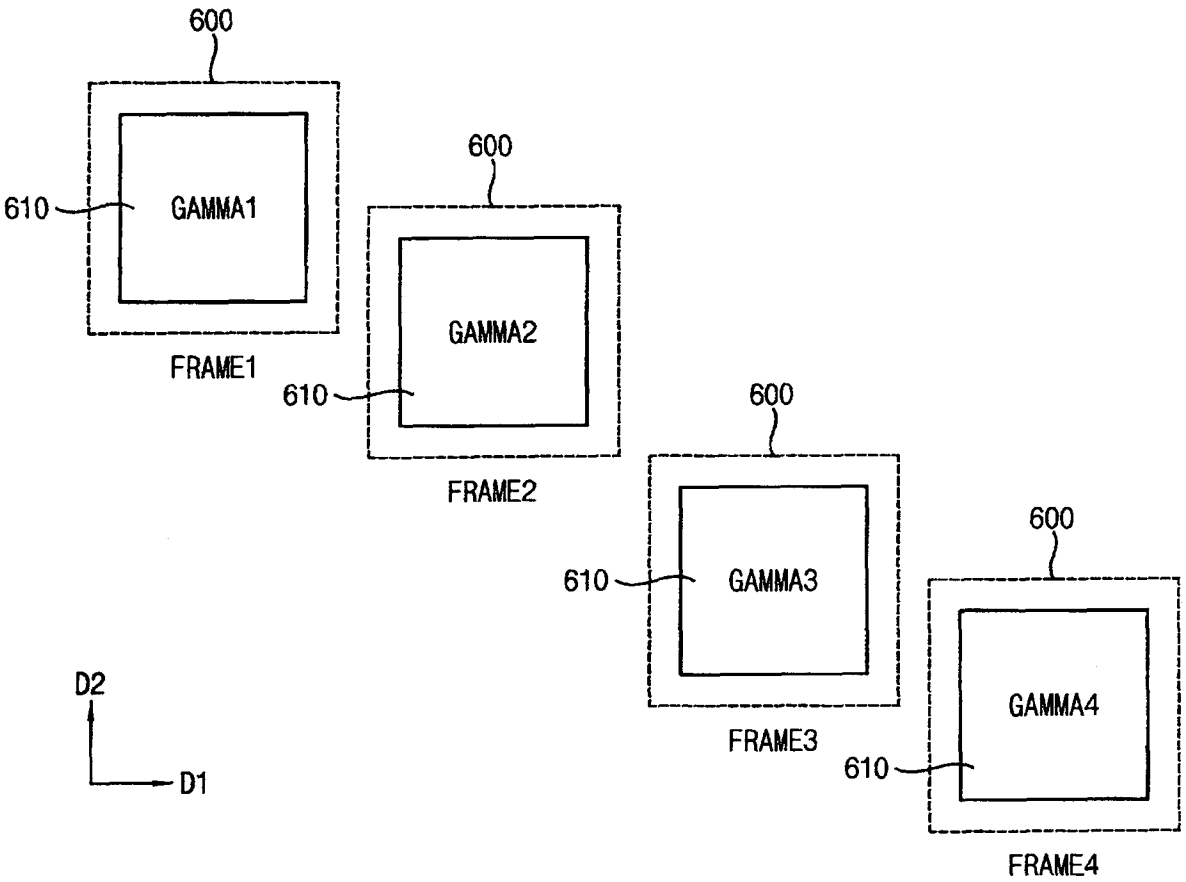
FIG. 16 is a plan view illustrating a unit pixel when a position of a viewer is in a first area (e.g., less than a reference distance from a display panel), according to an embodiment of the present invention.
Figure 17:
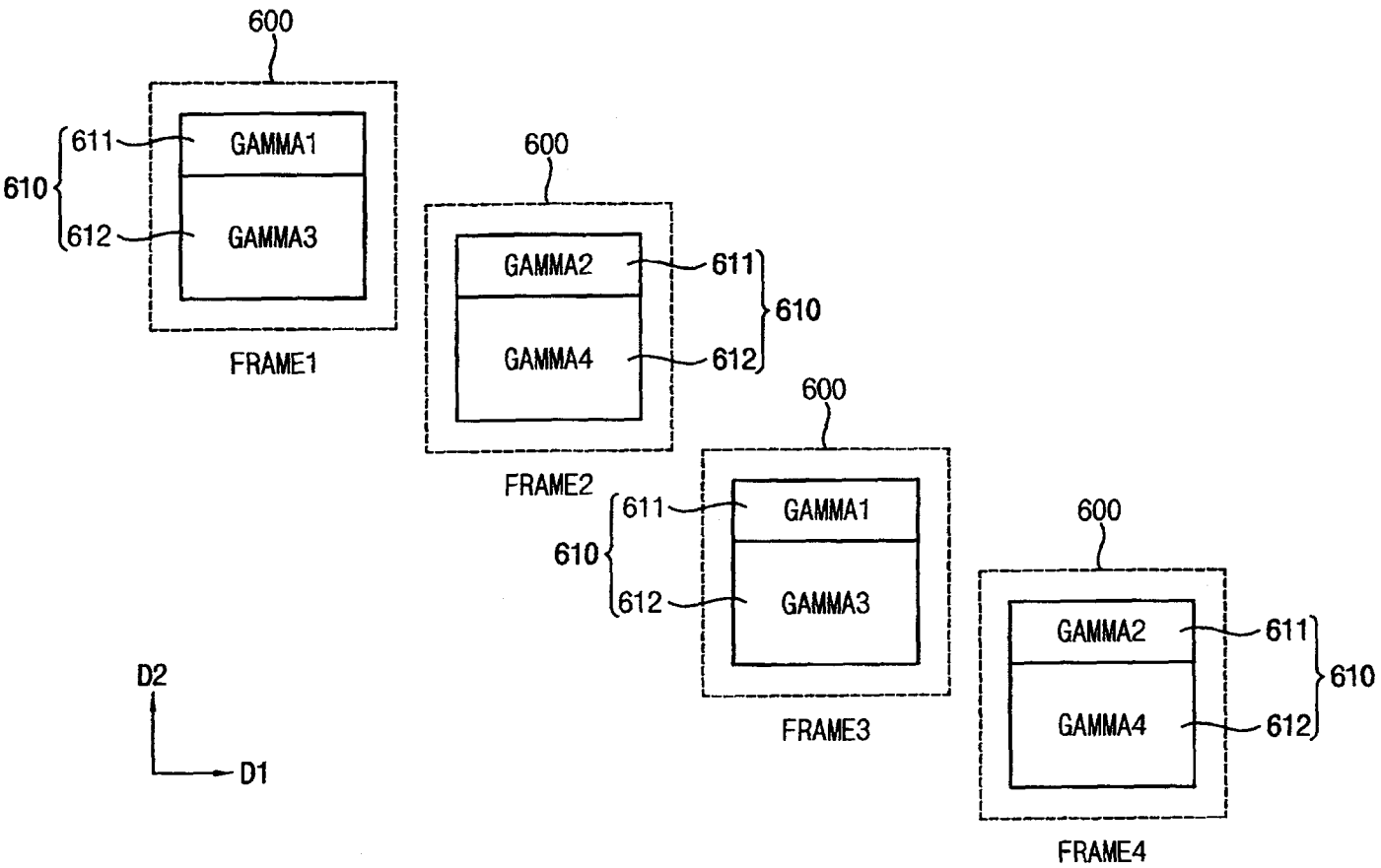
FIG. 17 is a plan view illustrating the unit pixel when the position of the viewer is in a second area (e.g., not less than the reference distance from the display panel), according to an embodiment of the present invention.

FIG. 16 is a plan view illustrating a unit pixel 600 when a position of a viewer is in a first area (e.g., less than a reference distance D from a display panel 110), and FIG. 17 is a plan view illustrating the unit pixel 600 when the position of the viewer is in a second area (e.g., not less than the reference distance D from the display panel 110), according to an embodiment of the present invention.

The unit pixel 600 may be included in the display panel 110 of the display apparatus 100 illustrated in FIG. 1, and may be driven by the display panel driving apparatus 101 of FIG. 1. Referring to FIGS. 1, 16, and 17, the unit pixel 600 may include a first sub pixel 610.

When the position of the viewer is in the first area, the unit pixel 600 is driven using a plurality of gamma values during a respective plurality of frames. Thus, the unit pixel 600 is driven using one gamma value during one frame. For example, the unit pixel 600 may be driven using a first gamma value GAMMA1 during a first frame FRAME1, the unit pixel 600 may be driven using a second gamma value GAMMA2 during a second frame FRAME2, the unit pixel 600 may be driven using a third gamma value GAMMA3 during a third frame FRAME3, and the unit pixel 600 may be driven using a fourth gamma value GAMMA4 during a fourth frame FRAME4. The data driving part 130 of FIG. 1 may output data signals having the gamma values GAMMA1, GAMMA2, GAMMA3, and GAMMA4 during the respective frames FRAME1, FRAME2, FRAME3, and FRAME4 to drive the unit pixel 600.

When the position of the viewer is in the second area, the unit pixel 600 is driven using two of the gamma values GAMMA1, GAMMA2, GAMMA3, and GAMMA4 during each of the frames FRAME1, FRAME2, FRAME3, and FRAME4. More specifically, when the position of the viewer is in the second area, the unit pixel 600 is driven using the first gamma value GAMMA1 and the third gamma value GAMMA3 during odd-numbered frames, and the unit pixel 600 is driven using the second gamma value GAMMA2 and the fourth gamma value GAMMA4 during even-numbered frames.

For example, the unit pixel 600 may be driven using the first gamma value GAMMA1 and the third gamma value GAMMA3 during the first frame FRAME1, the unit pixel 600 may be driven using the second gamma value GAMMA2 and the fourth gamma value GAMMA4 during the second frame FRAME2, the unit pixel 600 may be driven using the first gamma value GAMMA1 and the third gamma value GAMMA3 during the third frame FRAME3, and the unit pixel 600 may be driven using the second gamma value GAMMA2 and the fourth gamma value GAMMA4 during the fourth frame FRAME4.

The data driving part 130 of FIG. 1 may output a data signal DS having the first gamma value GAMMA1 and a data signal DS having the third gamma value GAMMA3 during the odd-numbered frames to drive the unit pixel 600, and may output a data signal DS having the second gamma value GAMMA2 and a data signal DS having the fourth gamma value GAMMA4 during the even-numbered frames to drive the unit pixel 600.

The first sub pixel 610 of the unit pixel 600 may include a first portion 611 and a second portion 612. The data signal DS having the first gamma value GAMMA1 may be applied to the first portion 611 of the first sub pixel 610 and the data signal DS having the third gamma value GAMMA3 may be applied to the second portion 612 of the first sub pixel 610 during the odd-numbered frames. The data signal DS having the second gamma value GAMMA2 may be applied to the first portion 611 of the first sub pixel 610 and the data signal DS having the fourth gamma value GAMMA4 may be applied to the second portion 612 of the first sub pixel 610 during the even-numbered frames.

Figure 18:
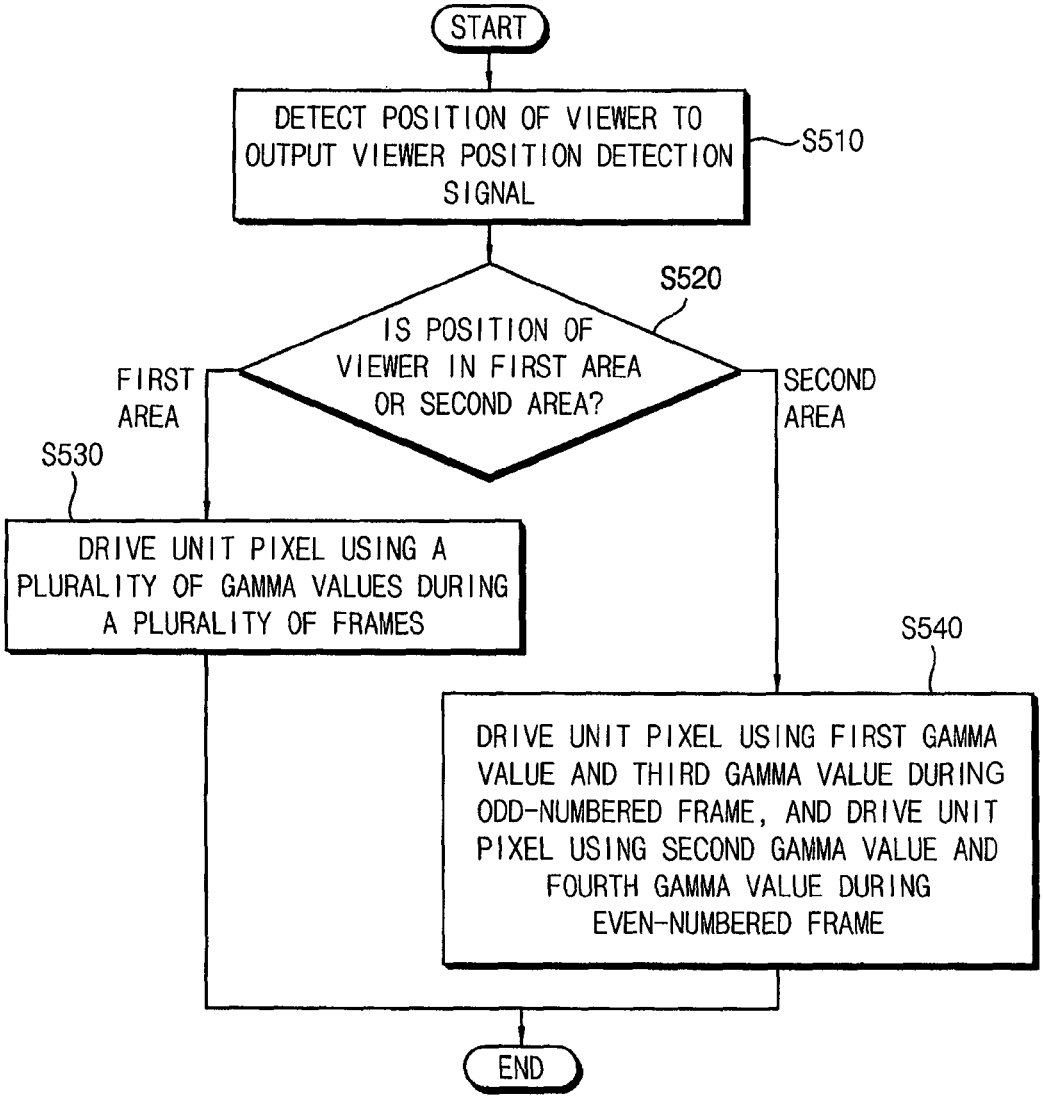
FIG. 18 is a flow chart illustrating a method of driving a display panel performed by the display panel driving apparatus of FIG. 1 driving the unit pixel of FIGS. 16 and 17.

FIG. 18 is a flow chart illustrating a method of driving a display panel 110 performed by the display panel driving apparatus 101 of FIG. 1 driving the unit pixel 600 of FIGS. 16 and 17.

Referring to FIGS. 1, 2, and 16 to 18, the position of the viewer is detected and the viewer position detection signal OPDS is outputted (step S510). More specifically, the viewer position detector 171 of the viewer position determining part 170 in FIG. 2 calculates the distance D between the unit pixel 600 and the eyes 180 of the viewer.

In step S520, it is determined whether the position of the viewer is in the first area or the second area. More specifically, the viewer position determiner 172 of the viewer position determining part 170 in FIG. 2 receives the viewer position detection signal OPDS, and determines whether the position of the viewer is in the first area (e.g., less than the reference distance D from the display panel 110) or in the second area (e.g., not less than the reference distance D from the display panel 110) to output the user position signal OPS.

When the position of the viewer is in the first area, the unit pixel 600 is driven using the gamma values GAMMA1, GAMMA2, GAMMA3, and GAMMA4 (step S530). For example, the data driving part 130 of FIG. 1 may output data signals having the gamma values GAMMA1, GAMMA2, GAMMA3, and GAMMA4 during the respective frames FRAME1, FRAME2, FRAME3, and FRAME4 to drive the unit pixel 600.

In step S540, when the position of the viewer is in the second area, the unit pixel 600 is driven using the first gamma value GAMMA1 and the third gamma value GAMMA3 during the odd-numbered frames, and the unit pixel 600 is driven using the second gamma value GAMMA2 and the fourth gamma value GAMMA4 during the even-numbered frames. For example, the data driving part 130 of FIG. 1 may output the data signal DS having the first gamma value GAMMA1 and the data signal DS having the third gamma value GAMMA3 during the odd-numbered frames to drive the unit pixel 600, and may output the data signal DS having the second gamma value GAMMA2 and the data signal DS having the fourth gamma value GAMMA4 during the even-numbered frames to drive the unit pixel 600.

According to the present embodiment, the unit pixel 600 is driven using two of the first to fourth gamma values GAMMA1, GAMMA2, GAMMA3, and GAMMA4 during each of the frames and therefore, side visibility of the display apparatus 100 may be improved. In addition, when the viewer is in the first area where the viewer may recognize a change of resolution of an image, the unit pixel 600 is driven using a single gamma value during each of the frames and therefore, a decrease of the resolution of the image displayed on the display panel 110 may be reduced or prevented.

Figure 19:
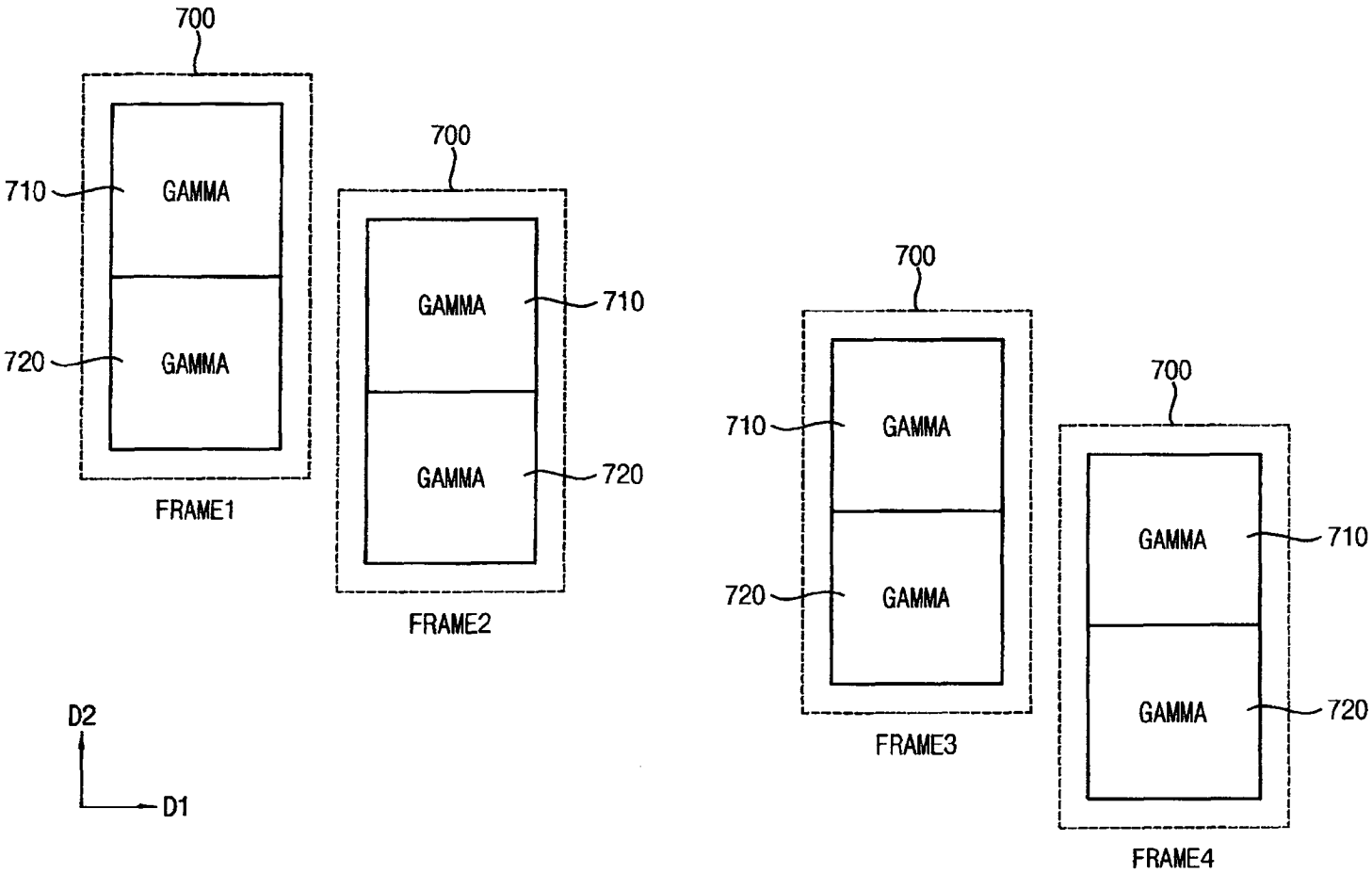
FIG. 19 is a plan view illustrating a unit pixel when a position of a viewer is in a first area (e.g., less than a reference distance from a display panel), according to an embodiment of the present invention.
Figure 20:
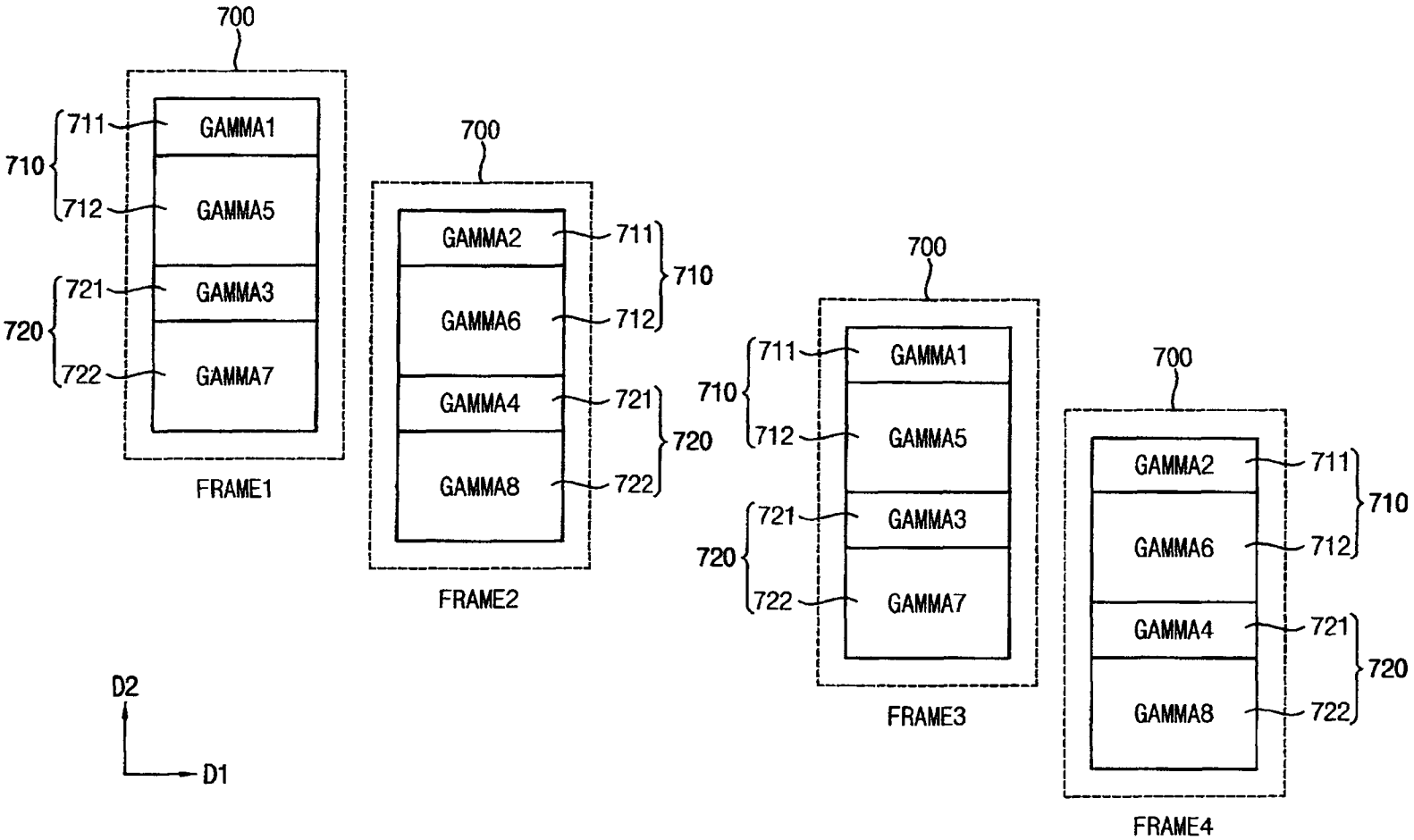
FIG. 20 is a plan view illustrating the unit pixel when the position of the viewer is in a second area (e.g., not less than the reference distance from the display panel), according to an embodiment of the present invention.

FIG. 19 is a plan view illustrating a unit pixel 700 when a position of a viewer is in a first area (e.g., less than a reference distance D from a display panel 110), and FIG. 20 is a plan view illustrating the unit pixel 700 when the position of the viewer is in a second area (e.g., not less than the reference distance D from the display panel 110), according to an embodiment of the present invention.

The unit pixel 700 may be included in the display panel 110 of the display apparatus 100 illustrated in FIG. 1, and may be driven by the display panel driving apparatus 101 of FIG. 1. Referring to FIGS. 1, 19, and 20, the unit pixel 700 may include a first sub pixel 710 and a second sub pixel 720. The second sub pixel 720 may be disposed from the first sub pixel 710 in a second direction D2.

When the position of the viewer is in the first area, the unit pixel 700 is driven using a single gamma value GAMMA. More specifically, when the position of the viewer is in the first area, the first sub pixel 710 and the second sub pixel 720 are driven using the single gamma value GAMMA during each of frames. For example, the first sub pixel 710 and the second sub pixel 720 may be driven using the single gamma value GAMMA during a first frame FRAME1, the first sub pixel 710 and the second sub pixel 720 may be driven using the single gamma value GAMMA during a second frame FRAME2, the first sub pixel 710 and the second sub pixel 720 may be driven using the single gamma value GAMMA during a third frame FRAME3, and the first sub pixel 710 and the second sub pixel 720 may be driven using the single gamma value GAMMA during a fourth frame FRAME4.

The data driving part 130 of FIG. 1 may output a data signal DS having the single gamma value GAMMA during the first to fourth frames FRAME1, FRAME2, FRAME3, and FRAME4 to drive the first sub pixel 710 and the second sub pixel 720.

When the position of the viewer is in the second area, the unit pixel 700 is driven using a plurality of gamma values. More specifically, when the position of the viewer is in the second area, the first sub pixel 710 is driven using a first gamma value GAMMA1 and a fifth gamma value GAMMA5, and the second sub pixel 720 is driven using a third gamma value GAMMA3 and a seventh gamma value GAMMA7 during odd-numbered frames. In addition, the first sub pixel 710 is driven using a second gamma value GAMMA2 and a sixth gamma value GAMMA6, and the second sub pixel 720 is driven using a fourth gamma value GAMMA4 and an eighth gamma value GAMMA8 during even-numbered frames.

For example, the first sub pixel 710 may be driven using the first gamma value GAMMA1 and the fifth gamma value GAMMA5, and the second sub pixel 720 may be driven using the third gamma value GAMMA3 and the seventh gamma value GAMMA7 during the first frame FRAME1, the first sub pixel 710 may be driven using the second gamma value GAMMA2 and the sixth gamma value GAMMA6, and the second sub pixel 720 may be driven using the fourth gamma value GAMMA4 and the eighth gamma value GAMMA8 during the second frame FRAME2, the first sub pixel 710 may be driven using the first gamma value GAMMA1 and the fifth gamma value GAMMA5, and the second sub pixel 720 may be driven using the third gamma value GAMMA3 and the seventh gamma value GAMMA7 during the third frame FRAME3, and the first sub pixel 710 may be driven using the second gamma value GAMMA2 and the sixth gamma value GAMMA6, and the second sub pixel 720 may be driven using the fourth gamma value GAMMA4 and the eighth gamma value GAMMA8 during the fourth frame FRAME4.

The data driving part 130 of FIG. 1 may output a data signal DS having the first gamma value GAMMA1 and a data signal DS having the fifth gamma value GAMMA5 to drive the first sub pixel 710, and may output a data signal DS having the third gamma value GAMMA3 and a data signal DS having the seventh gamma value GAMMA7 to drive the second sub pixel 720 during the odd-numbered frames. In addition, the data driving part 130 may output a data signal DS having the second gamma value GAMMA2 and a data signal DS having the sixth gamma value GAMMA6 to drive the first sub pixel 710, and may output a data signal DS having the fourth gamma value GAMMA4 and a data signal DS having the eighth gamma value GAMMA8 to drive the second sub pixel 720 during the even-numbered frames.

The first sub pixel 710 of the unit pixel 700 may include a first portion 711 and a second portion 712. The data signal DS having the first gamma value GAMMA1 may be applied to the first portion 711 of the first sub pixel 710 and the data signal DS having the fifth gamma value GAMMA5 may be applied to the second portion 712 of the first sub pixel 710 during the odd-numbered frames. The data signal DS having the second gamma value GAMMA2 may be applied to the first portion 711 of the first sub pixel 710 and the data signal DS having the sixth gamma value GAMMA6 may be applied to the second portion 712 of the first sub pixel 710 during the even-numbered frames.

In addition, the second sub pixel 720 of the unit pixel 700 may include a first portion 721 and a second portion 722. The data signal DS having the third gamma value GAMMA3 may be applied to the first portion 721 of the second sub pixel 720 and the data signal DS having the seventh gamma value GAMMA7 may be applied to the second portion 722 of the second sub pixel 720 during the odd-numbered frames. The data signal DS having the fourth gamma value GAMMA4 may be applied to the first portion 721 of the second sub pixel 720 and the data signal DS having the eighth gamma value GAMMA8 may be applied to the second portion 722 of the second sub pixel 720 during the even-numbered frames.

The fifth gamma value GAMMA5 may be less than the first gamma value GAMMA1, the sixth gamma value GAMMA6 may be less than the second gamma value GAMMA2, the seventh gamma value GAMMA7 may be less than the third gamma value GAMMA3, and the eighth gamma value GAMMA8 may be less than the fourth gamma value GAMMA4. Thus, the fifth gamma value GAMMA5 may be determined according to the first gamma value GAMMA1, the sixth gamma value GAMMA6 may be determined according to the second gamma value GAMMA2, the seventh gamma value GAMMA7 may be determined according to the third gamma value GAMMA3, and the eighth gamma value GAMMA8 may be determined according to the fourth gamma value GAMMA4.

In addition, the first gamma value GAMMA1 may be a white color gamma value, the seventh gamma value may be a black color gamma value, and the second gamma value GAMMA2, the third gamma value GAMMA3, and the fourth gamma value GAMMA4 may be between the first gamma value GAMMA1 and the seventh gamma value GAMMA7.

Figure 21:
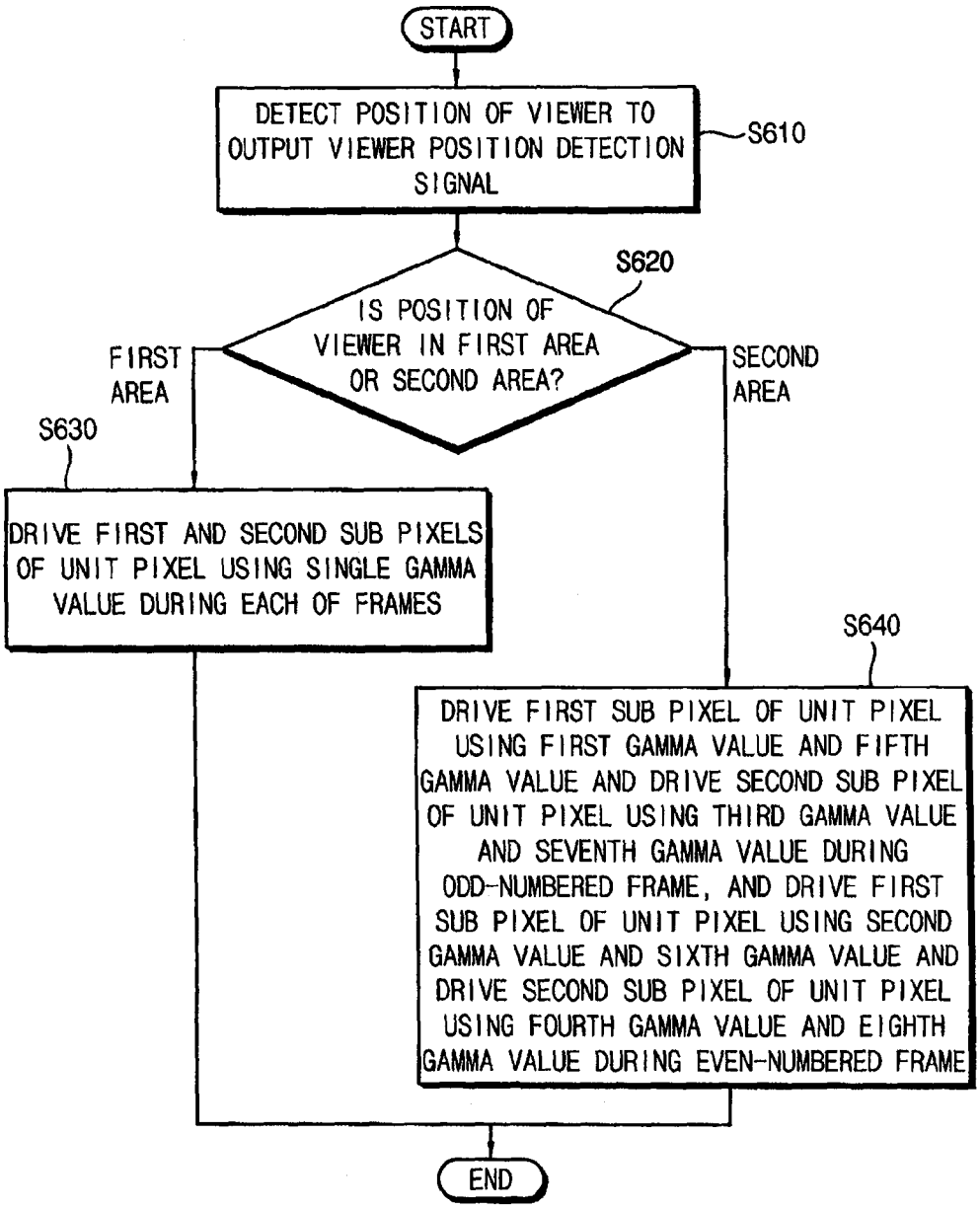
FIG. 21 is a flow chart illustrating a method of driving a display panel performed by the display panel driving apparatus of FIG. 1 driving the unit pixel of FIGS. 19 and 20.

FIG. 21 is a flow chart illustrating a method of driving a display panel 110 performed by the display panel driving apparatus 101 of FIG. 1 driving the unit pixel 700 of FIGS. 19 and 20.

Referring to FIGS. 1, 2, and 19 to 21, the position of the viewer is detected and the viewer position detection signal OPDS is outputted (step S610). More specifically, the viewer position detector 171 of the viewer position determining part 170 in FIG. 2 calculates the distance D between the unit pixel 700 and the eyes 180 of the viewer.

In step S620, it is determined whether the position of the viewer is in the first area or the second area. More specifically, the viewer position determiner 172 of the viewer position determining part 170 in FIG. 2 receives the viewer position detection signal OPDS, and determines whether the position of the viewer is in the first area (e.g., less than the reference distance D from the display panel 110) or in the second area (e.g., not less than the reference distance D from the display panel 110) to output the user position signal OPS.

When the position of the viewer is in the first area, the first sub pixel 710 and the second sub pixel 720 are driven using the single gamma value GAMMA during each of the frames FRAME1, FRAME2, FRAME3, and FRAME4 (step S630). For example, the data driving part 130 of FIG. 1 may output the data signal DS having the single gamma value GAMMA during each of the first to fourth frames FRAME1, FRAME2, FRAME3, and FRAME4 to drive the first sub pixel 710 and the second sub pixel 720.

In step S640, when the position of the viewer is in the second area, the first sub pixel 710 is driven using the first gamma value GAMMA1 and the fifth gamma value GAMMA5, and the second sub pixel 720 is driven using the third gamma value GAMMA3 and the seventh gamma value GAMMA7 during the odd-numbered frames. In addition, the first sub pixel 710 is driven using the second gamma value GAMMA2 and the sixth gamma value GAMMA6, and the second sub pixel 720 is driven using the fourth gamma value GAMMA4 and the eighth gamma value GAMMA8 during the even-numbered frames.

For example, the data driving part 130 of FIG. 1 may output the data signal DS having the first gamma value GAMMA1 and the data signal DS having the fifth gamma value GAMMA5 to drive the first sub pixel 710, and may output the data signal DS having the third gamma value GAMMA3 and the data signal DS having the seventh gamma value GAMMA7 to drive the second sub pixel 720 during the odd-numbered frames. In addition, the data driving part 130 may output the data signal DS having the second gamma value GAMMA2 and the data signal DS having the sixth gamma value GAMMA6 to drive the first sub pixel 710, and may output the data signal DS having the fourth gamma value GAMMA4 and the data signal DS having the eighth gamma value GAMMA8 to drive the second sub pixel 720 during the even-numbered frames.

According to the present embodiment, the unit pixel 700 is driven using the first to eighth gamma values GAMMA1, GAMMA2, . . . , and GAMMA8 and therefore, side visibility of the display apparatus 100 may be improved. In addition, when the viewer is in the first area where the viewer may recognize a change of resolution of an image, the unit pixel 700 is driven using the single gamma value GAMMA and therefore, a decrease of the resolution of the image displayed on the display panel 110 may be reduced or prevented.

Figure 22:
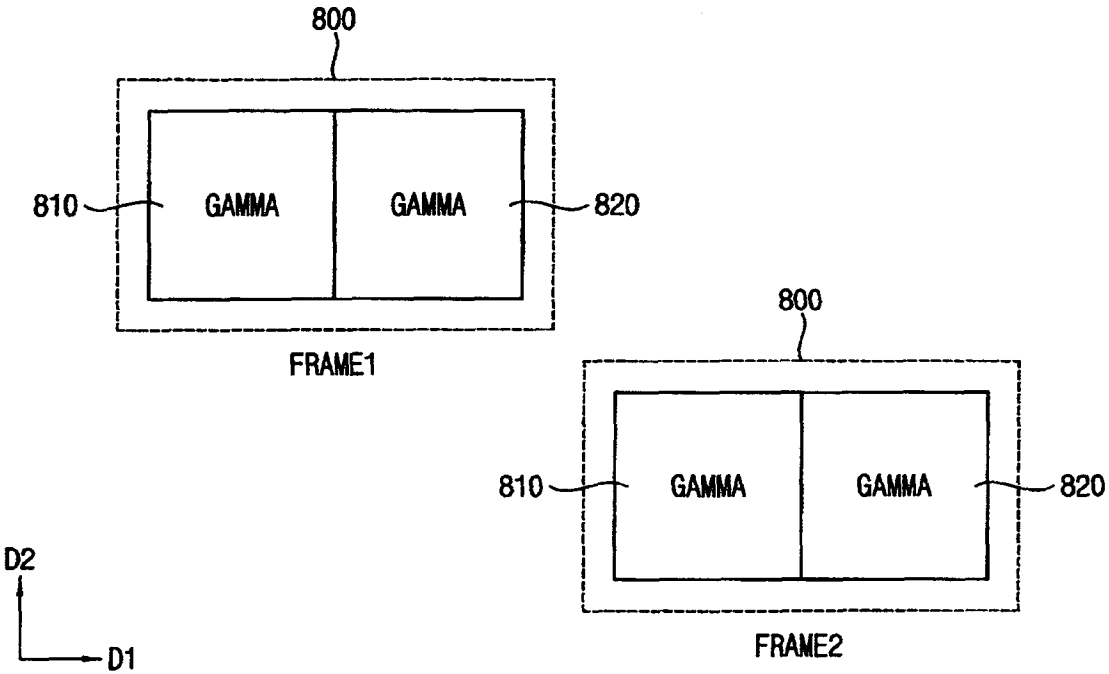
FIG. 22 is a plan view illustrating a unit pixel when a position of a viewer is in a first area (e.g., less than a reference distance from a display panel), according to an embodiment of the present invention.
Figure 23:
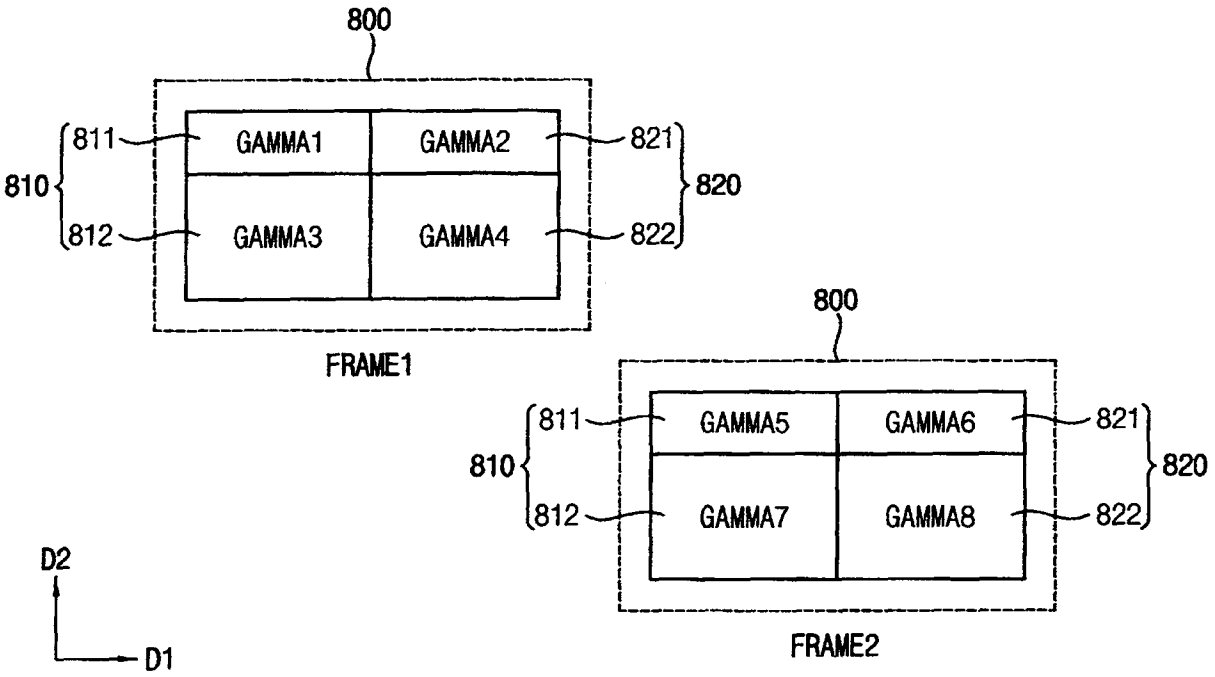
FIG. 23 is a plan view illustrating the unit pixel when the position of the viewer is in a second area (e.g., not less than the reference distance from the display panel), according to an embodiment of the present invention.

FIG. 22 is a plan view illustrating a unit pixel 800 when a position of a viewer is in a first area (e.g., less than a reference distance D from a display panel 110), and FIG. 23 is a plan view illustrating the unit pixel 800 when the position of the viewer is in a second area (e.g., not less than the reference distance D from the display panel 110), according to an embodiment of the present invention.

The unit pixel 800 may be included in the display panel 110 of the display apparatus 100 illustrated in FIG. 1, and may be driven by the display panel driving apparatus 101 of FIG. 1. Referring to FIGS. 1, 22, and 23, the unit pixel 800 may include a first sub pixel 810 and a second sub pixel 820. The second sub pixel 820 may be disposed from the first sub pixel 810 in a first direction D1.

When the position of the viewer is in the first area, the unit pixel 800 is driven using a single gamma value GAMMA. More specifically, when the position of the viewer is in the first area, the first sub pixel 810 and the second sub pixel 820 are driven using the single gamma value GAMMA during each of frames. For example, the first sub pixel 810 and the second sub pixel 820 may be driven using the single gamma value GAMMA during a first frame FRAME1, and the first sub pixel 810 and the second sub pixel 820 may be driven using the single gamma value GAMMA during a second frame FRAME2. The data driving part 130 of FIG. 1 may output a data signal DS having the single gamma value GAMMA during each of the first and second frames FRAME1 and FRAME2 to drive the first sub pixel 810 and the second sub pixel 820.

When the position of the viewer is in the second area, the unit pixel 800 is driven using a plurality of gamma values. More specifically, when the position of the viewer is in the second area, the first sub pixel 810 is driven using a first gamma value GAMMA1 and a third gamma value GAMMA3, and the second sub pixel 820 is driven using a second gamma value GAMMA2 and a fourth gamma value GAMMA4 during odd-numbered frames. In addition, the first sub pixel 810 is driven using a fifth gamma value GAMMA5 and a seventh gamma value GAMMA7, and the second sub pixel 820 is driven using a sixth gamma value GAMMA6 and an eighth gamma value GAMMA8 during even-numbered frames.

For example, the first sub pixel 810 may be driven using the first gamma value GAMMA1 and the third gamma value GAMMA3, and the second sub pixel 820 may be driven using the second gamma value GAMMA2 and the fourth gamma value GAMMA4 during the first frame FRAME1. In addition, the first sub pixel 810 may be driven using the fifth gamma value GAMMA5 and the seventh gamma value GAMMA7, and the second sub pixel 820 may be driven using the sixth gamma value GAMMA6 and the eighth gamma value GAMMA8 during the second frame FRAME2.

The data driving part 130 of FIG. 1 may output a data signal DS having the first gamma value GAMMA1 and a data signal DS having the third gamma value GAMMA3 to drive the first sub pixel 810, and may output a data signal DS having the second gamma value GAMMA2 and a data signal DS having the fourth gamma value GAMMA4 to drive the second sub pixel 820 during the odd-numbered frames. In addition, the data driving part 130 may output a data signal DS having the fifth gamma value GAMMA5 and a data signal DS having the seventh gamma value GAMMA7 to drive the first sub pixel 810, and may output a data signal DS having the sixth gamma value GAMMA6 and a data signal DS having the eighth gamma value GAMMA8 to drive the second sub pixel 820 during the even-numbered frames.

The first sub pixel 810 of the unit pixel 800 may include a first portion 811 and a second portion 812. The data signal DS having the first gamma value GAMMA1 may be applied to the first portion 811 of the first sub pixel 810, and the data signal DS having the third gamma value GAMMA3 may be applied to the second portion 812 of the first sub pixel 810 during the odd-numbered frames. The data signal DS having the fifth gamma value GAMMA5 may be applied to the first portion 811 of the first sub pixel 810, and the data signal DS having the seventh gamma value GAMMA7 may be applied to the second portion 812 of the first sub pixel 810 during the even-numbered frames.

In addition, the second sub pixel 820 of the unit pixel 800 may include a first portion 821 and a second portion 822. The data signal DS having the second gamma value GAMMA2 may be applied to the first portion 821 of the second sub pixel 820, and the data signal DS having the fourth gamma value GAMMA4 may be applied to the second portion 822 of the second sub pixel 820 during the odd-numbered frames. The data signal DS having the sixth gamma value GAMMA6 may be applied to the first portion 821 of the second sub pixel 820, and the data signal DS having the eighth gamma value GAMMA8 may be applied to the second portion 822 of the second sub pixel 820 during the even-numbered frames.

The first gamma value GAMMA1 may be a white color gamma value, the seventh gamma value GAMMA7 may be a black color gamma value, and the second gamma value GAMMA2, the third gamma value GAMMA3, the fourth gamma value GAMMA4, the fifth gamma value GAMMA5, the sixth gamma value GAMMA6 and the eighth gamma value GAMMA8 may be between the first gamma value GAMMA1 and the seventh gamma value GAMMA7.

Figure 24:
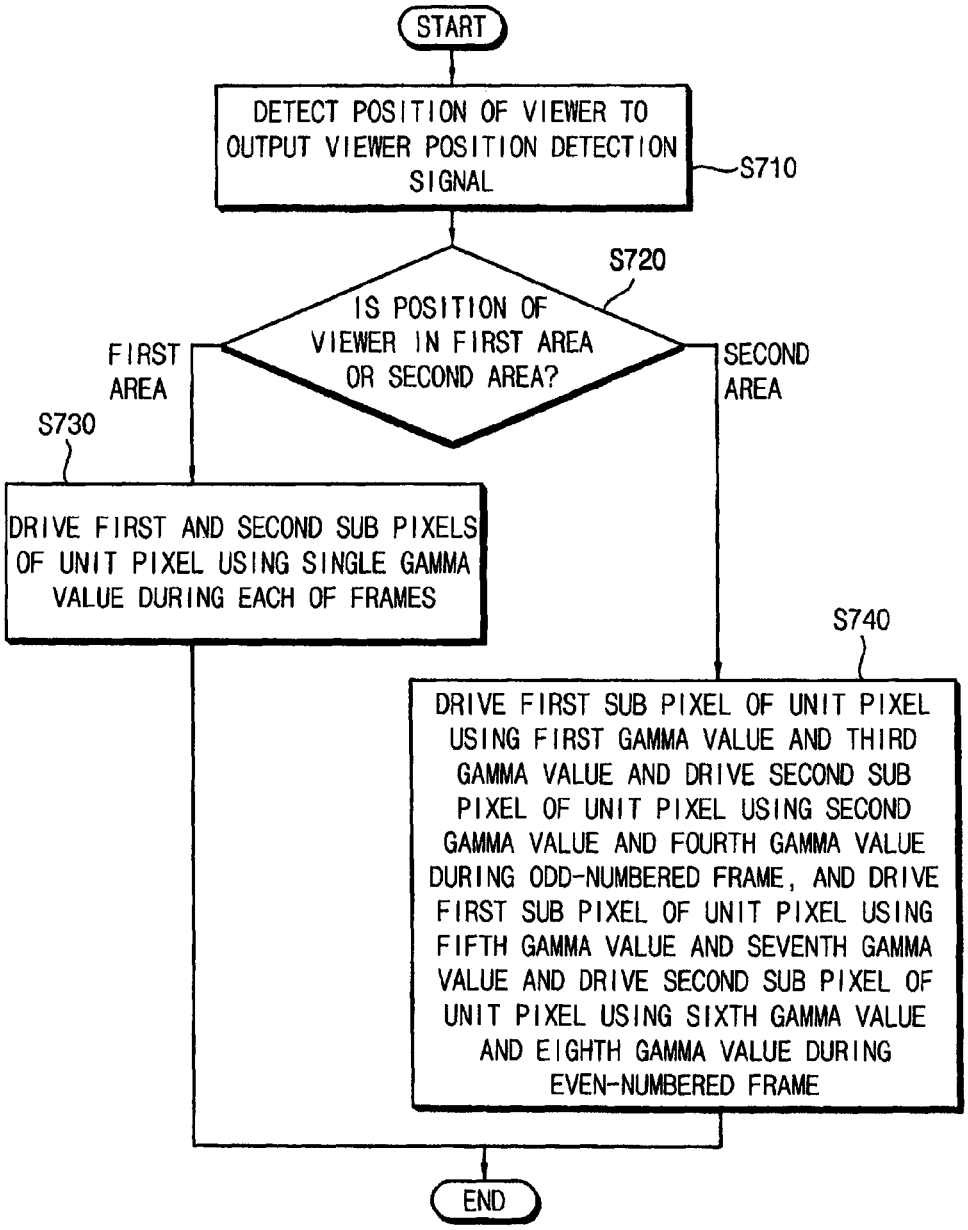
FIG. 24 is a flow chart illustrating a method of driving a display panel performed by the display panel driving apparatus of FIG. 1 driving the unit pixel of FIGS. 22 and 23.

FIG. 24 is a flow chart illustrating a method of driving a display panel 110 performed by the display panel driving apparatus 101 of FIG. 1 driving the unit pixel 800 of FIGS. 22 and 23.

Referring to FIGS. 1, 2, and 22 to 24, the position of the viewer is detected and the viewer position detection signal OPDS is outputted (step S710). More specifically, the viewer position detector 171 of the viewer position determining part 170 in FIG. 2 calculates the distance D between the unit pixel 800 and the eyes 180 of the viewer.

In step S720, it is determined whether the position of the viewer is in the first area or the second area. More specifically, the viewer position determiner 172 of the viewer position determining part 170 in FIG. 2 receives the viewer position detection signal OPDS, and determines whether the position of the viewer is in the first area (e.g., less than the reference distance D from the display panel 110) or in the second area (e.g., not less than the reference distance D from the display panel 110) to output the user position signal OPS.

When the position of the viewer is in the first area, the first sub pixel 810 and the second sub pixel 820 are driven using the single gamma value GAMMA during each of the frames FRAME1 and FRAME2 (step S730). For example, the data driving part 130 of FIG. 1 may output the data signal DS having the single gamma value GAMMA during each of the first and second frames FRAME1 and FRAME2 to drive the first sub pixel 810 and the second sub pixel 820.

In step S740, when the position of the viewer is in the second area, the first sub pixel 810 is driven using the first gamma value GAMMA1 and the third gamma value GAMMA3, and the second sub pixel 820 is driven using the second gamma value GAMMA2 and the fourth gamma value GAMMA4 during the odd-numbered frames. In addition, the first sub pixel 810 is driven using the fifth gamma value GAMMA5 and the seventh gamma value GAMMA7, and the second sub pixel 820 is driven using the sixth gamma value GAMMA6 and the eighth gamma value GAMMA8 during the even-numbered frames.

For example, the data driving part 130 of FIG. 1 may output the data signal DS having the first gamma value GAMMA1 and the data signal DS having the third gamma value GAMMA3 to drive the first sub pixel 810, and may output the data signal DS having the second gamma value GAMMA2 and the data signal DS having the fourth gamma value GAMMA4 to drive the second sub pixel 820 during the odd-numbered frames. In addition, the data driving part 130 may output the data signal DS having the fifth gamma value GAMMA5 and the data signal DS having the seventh gamma value GAMMA7 to drive the first sub pixel 810, and may output the data signal DS having the sixth gamma value GAMMA6 and the data signal DS having the eighth gamma value GAMMA8 to drive the second sub pixel 820 during the even-numbered frames.

According to the present embodiment, the unit pixel 800 is driven using the first to eighth gamma values GAMMA1, GAMMA2, . . . , and GAMMA8 and therefore, side visibility of the display apparatus 100 may be improved. In addition, when the viewer is in the first area where the viewer may recognize a change of resolution of an image, the unit pixel 800 is driven using the single gamma value GAMMA and therefore, a decrease of the resolution of the image displayed on the display panel 110 may be reduced or prevented.

Figure 25:
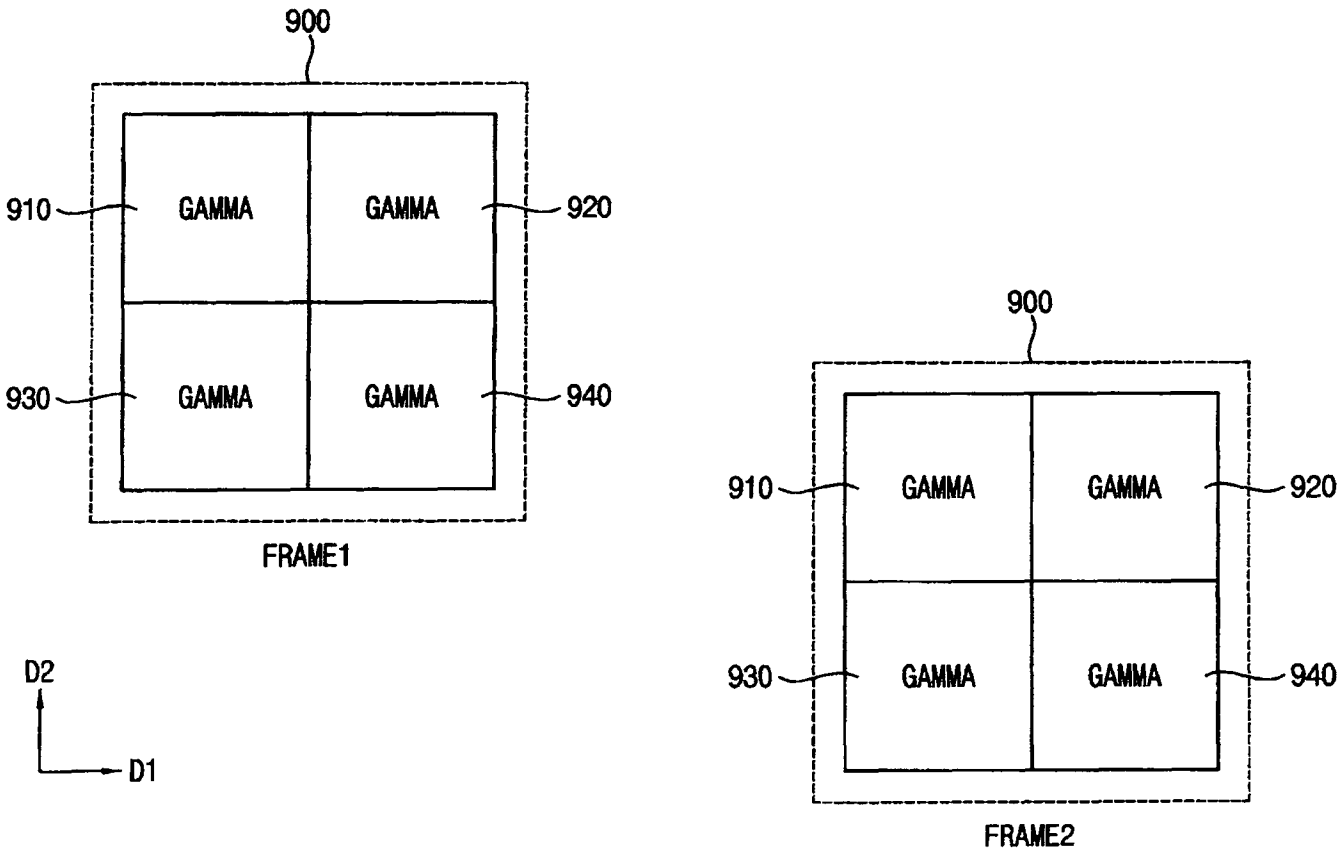
FIG. 25 is a plan view illustrating a unit pixel when a position of a viewer is in a first area (e.g., less than a reference distance from a display panel), according to an embodiment of the present invention.
Figure 26:
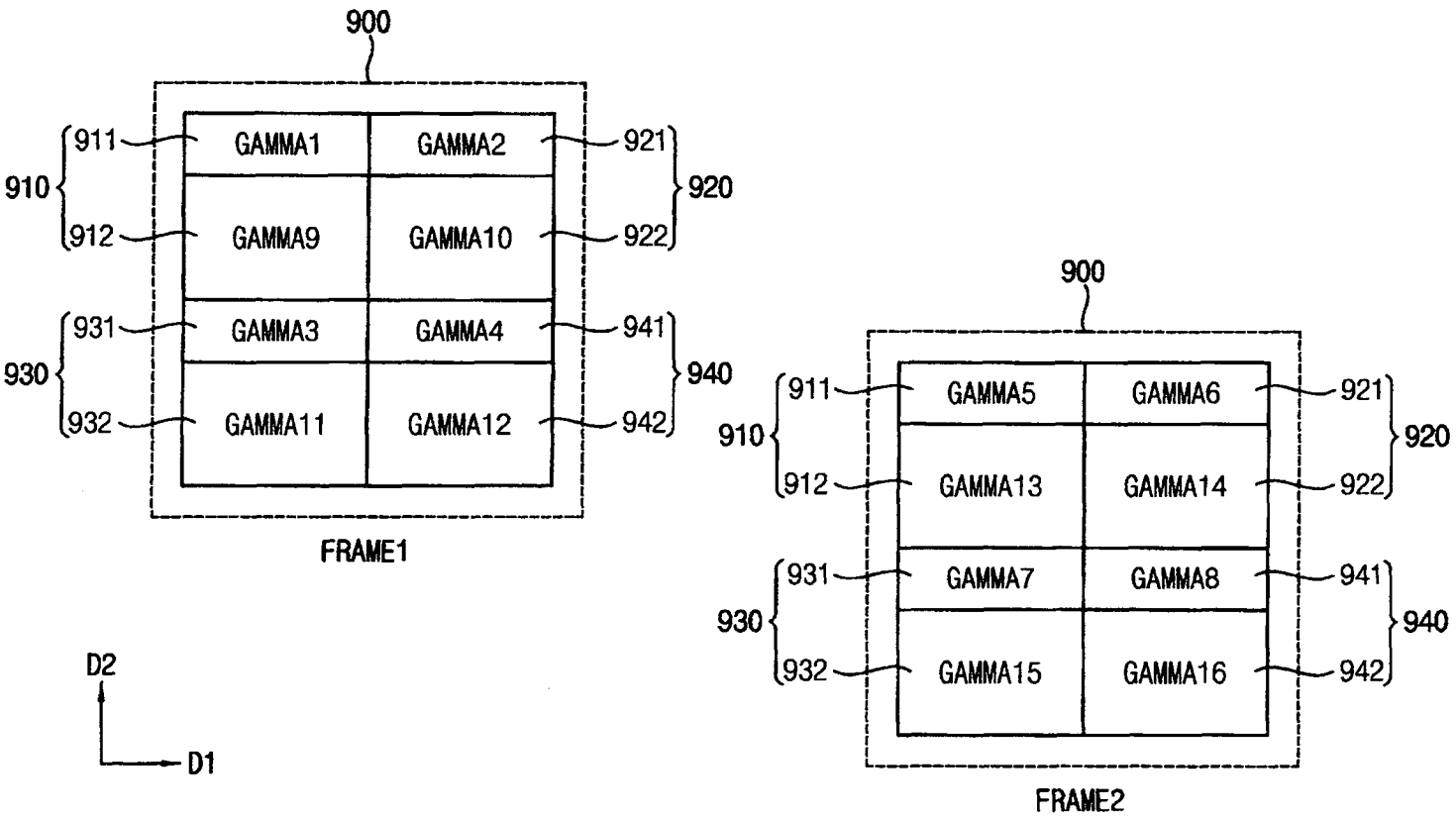
FIG. 26 is a plan view illustrating the unit pixel when the position of the viewer is in a second area (e.g., not less than the reference distance from the display panel), according to an embodiment of the present invention.

FIG. 25 is a plan view illustrating a unit pixel 900 when a position of a viewer is in a first area (e.g., less than a reference distance D from a display panel 110), and FIG. 26 is a plan view illustrating the unit pixel 900 when the position of the viewer is in a second area (e.g., not less than the reference distance D from the display panel 110), according to an embodiment of the present invention.

The unit pixel 900 may be included in the display panel 110 of the display apparatus 100 illustrated in FIG. 1, and may be driven by the display panel driving apparatus 101 of FIG. 1. Referring to FIGS. 1, 25, and 26, the unit pixel 900 may include a first sub pixel 910, a second sub pixel 920, a third sub pixel 930, and a fourth sub pixel 940. The second sub pixel 920 is disposed from the first sub pixel 910 in a first direction D1. The third sub pixel 930 is disposed from the first sub pixel 910 in a second direction D2. The fourth sub pixel 940 is disposed from the third sub pixel 930 in the first direction D1.

When the position of the viewer is in the first area, the unit pixel 900 is driven using a single gamma value GAMMA. More specifically, when the position of the viewer is in the first area, the first sub pixel 910, the second sub pixel 920, the third sub pixel 930, and the fourth sub pixel 940 are driven using the single gamma value GAMMA during each of frames. For example, the first sub pixel 910, the second sub pixel 920, the third sub pixel 930, and the fourth sub pixel 940 may be driven using the single gamma value GAMMA during a first frame FRAME1, and the first sub pixel 910, the second sub pixel 920, the third sub pixel 930, and the fourth sub pixel 940 may be driven using the single gamma value GAMMA during a second frame FRAME2.

The data driving part 130 of FIG. 1 may output a data signal DS having the single gamma value GAMMA during each of the first and second frames FRAME1 and FRAME2 to drive the first sub pixel 910, the second sub pixel 920, the third sub pixel 930, and the fourth sub pixel 940.

When the position of the viewer is in the second area, the unit pixel 900 is driven using a plurality of gamma values. More specifically, when the position of the viewer is in the second area, the first sub pixel 910 is driven using a first gamma value GAMMA1 and a ninth gamma value GAMMA9, the second sub pixel 920 is driven using a second gamma value GAMMA2 and a tenth gamma value GAMMA10, the third sub pixel 930 is driven using a third gamma value GAMMA3 and an eleventh gamma value GAMMA11, and the fourth sub pixel 940 is driven using a fourth gamma value GAMMA4 and a twelfth gamma value GAMMA12 during odd-numbered frames.

In addition, the first sub pixel 910 is driven using a fifth gamma value GAMMA5 and a thirteenth gamma value GAMMA13, the second sub pixel 920 is driven using a sixth gamma value GAMMA6 and a fourteenth gamma value GAMMA14, the third sub pixel 930 is driven using a seventh gamma value GAMMA7 and a fifteenth gamma value GAMMA15, and the fourth sub pixel 940 is driven using an eighth gamma value GAMMA8 and a sixteenth gamma value GAMMA16 during an even-numbered frames.

For example, the first sub pixel 910 may be driven using the first gamma value GAMMA1 and the ninth gamma value GAMMA9, the second sub pixel 920 may be driven using the second gamma value GAMMA2 and the tenth gamma value GAMMA10, the third sub pixel 930 may be driven using the third gamma value GAMMA3 and the eleventh gamma value GAMMA11, and the fourth sub pixel 940 may be driven using the fourth gamma value GAMMA4 and the twelfth gamma value GAMMA12 during the first frame FRAME1.

In addition, the first sub pixel 910 may be driven using the fifth gamma value GAMMA5 and the thirteenth gamma value GAMMA13, the second sub pixel 920 may be driven using the sixth gamma value GAMMA6 and the fourteenth gamma value GAMMA14, the third sub pixel 930 may be driven using the seventh gamma value GAMMA7 and the fifteenth gamma value GAMMA15, and the fourth sub pixel 940 may be driven using the eighth gamma value GAMMA8 and the sixteenth gamma value GAMMA16 during the second frame FRAME2.

The data driving part 130 of FIG. 1 may output a data signal DS having the first gamma value GAMMA1 and a data signal DS having the ninth gamma value GAMMA9 to drive the first sub pixel 910, may output a data signal DS having the second gamma value GAMMA2 and a data signal DS having the tenth gamma value GAMMA10 to drive the second sub pixel 920, may output a data signal DS having the third gamma value GAMMA3 and a data signal DS having the eleventh gamma value GAMMA11 to drive the third sub pixel 930, and may output a data signal DS having the fourth gamma value GAMMA4 and a data signal DS having the twelfth gamma value GAMMA12 to drive the fourth sub pixel 940 during the odd-numbered frames.

In addition, the data driving part 130 may output a data signal DS having the fifth gamma value GAMMA5 and a data signal DS having the thirteenth gamma value GAMMA13 to drive the first sub pixel 910, may output a data signal DS having the sixth gamma value GAMMA6 and a data signal DS having the fourteenth gamma value GAMMA14 to drive the second sub pixel 920, may output a data signal DS having the seventh gamma value GAMMA7 and a data signal DS having the fifteenth gamma value GAMMA15 to drive the third sub pixel 930, and may output a data signal DS having the eighth gamma value GAMMA8 and a data signal DS having the sixteenth gamma value GAMMA16 to drive the fourth sub pixel 940 during the even-numbered frames.

The first sub pixel 910 of the unit pixel 900 may include a first portion 911 and a second portion 912. The data signal DS having the first gamma value GAMMA1 may be applied to the first portion 911 of the first sub pixel 910 and the data signal DS having the ninth gamma value GAMMA9 may be applied to the second portion 912 of the first sub pixel 910 during the odd-numbered frames. The data signal DS having the fifth gamma value GAMMA5 may be applied to the first portion 911 of the first sub pixel 910 and the data signal DS having the thirteenth gamma value GAMMA13 may be applied to the second portion 912 of the first sub pixel 910 during the even-numbered frames.

In addition, the second sub pixel 920 of the unit pixel 900 may include a first portion 921 and a second portion 922. The data signal DS having the second gamma value GAMMA2 may be applied to the first portion 921 of the second sub pixel 920 and the data signal DS having the tenth gamma value GAMMA10 may be applied to the second portion 922 of the second sub pixel 920 during the odd-numbered frames. The data signal DS having the sixth gamma value GAMMA6 may be applied to the first portion 921 of the second sub pixel 920 and the data signal DS having the fourteenth gamma value GAMMA14 may be applied to the second portion 922 of the second sub pixel 920 during the even-numbered frames.

In addition, the third sub pixel 930 of the unit pixel 900 may include a first portion 931 and a second portion 932. The data signal DS having the third gamma value GAMMA3 may be applied to the first portion 931 of the third sub pixel 930 and the data signal DS having the eleventh gamma value GAMMA11 may be applied to the second portion 932 of the third sub pixel 930 during the odd-numbered frames. The data signal DS having the seventh gamma value GAMMA7 may be applied to the first portion 931 of the third sub pixel 930 and the data signal DS having the fifteenth gamma value GAMMA15 may be applied to the second portion 932 of the third sub pixel 930 during the even-numbered frames.

In addition, the fourth sub pixel 940 of the unit pixel 900 may include a first portion 941 and a second portion 942. The data signal DS having the fourth gamma value GAMMA4 may be applied to the first portion 941 of the fourth sub pixel 940 and the data signal DS having the twelfth gamma value GAMMA12 may be applied to the second portion 942 of the fourth sub pixel 940 during the odd-numbered frames. The data signal DS having the eighth gamma value GAMMA8 may be applied to the first portion 941 of the fourth sub pixel 940 and the data signal DS having the sixteenth gamma value GAMMA16 may be applied to the second portion 942 of the fourth sub pixel 940 during the even-numbered frames.

The ninth gamma value GAMMA9 may be less than the first gamma value GAMMA1, the tenth gamma value GAMMA10 may be less than the second gamma value GAMMA2, the eleventh gamma value GAMMA11 may be less than the third gamma value GAMMA3, the twelfth gamma value GAMMA12 may be less than the fourth gamma value GAMMA4, the thirteenth gamma value GAMMA13 may be less than the fifth gamma value GAMMA5, the fourteenth gamma value GAMMA14 may be less than the sixth gamma value GAMMA6, the fifteenth gamma value GAMMA15 may be less than the seventh gamma value GAMMA7, and the sixteenth gamma value GAMMA16 may be less than the eighth gamma value GAMMA8.

Thus, the ninth gamma value GAMMA9 may be determined according to the first gamma value GAMMA1, the tenth gamma value GAMMA10 may be determined according to the second gamma value GAMMA2, the eleventh gamma value GAMMA11 may be determined according to the third gamma value GAMMA3, the twelfth gamma value GAMMA12 may be determined according to the fourth gamma value GAMMA4, the thirteenth gamma value GAMMA13 may be determined according to the fifth gamma value GAMMA5, the fourteenth gamma value GAMMA14 may be determined according to the sixth gamma value GAMMA6, the fifteenth gamma value GAMMA15 may be determined according to the seventh gamma value GAMMA7, and the sixteenth gamma value GAMMA16 may be determined according to the eighth gamma value GAMMA8.

The first gamma value GAMMA1 may be a white color gamma value, the fifteenth gamma value GAMMA15 may be a black color gamma value GAMMA15, and the second gamma value GAMMA2, the third gamma value GAMMA3, the fourth gamma value GAMMA4, the fifth gamma value GAMMA5, the sixth gamma value GAMMA6, the seventh gamma value GAMMA7 and the eighth gamma value GAMMA8 may be between the first gamma value GAMMA1 and the fifteenth gamma value GAMMA15.

Figure 27:
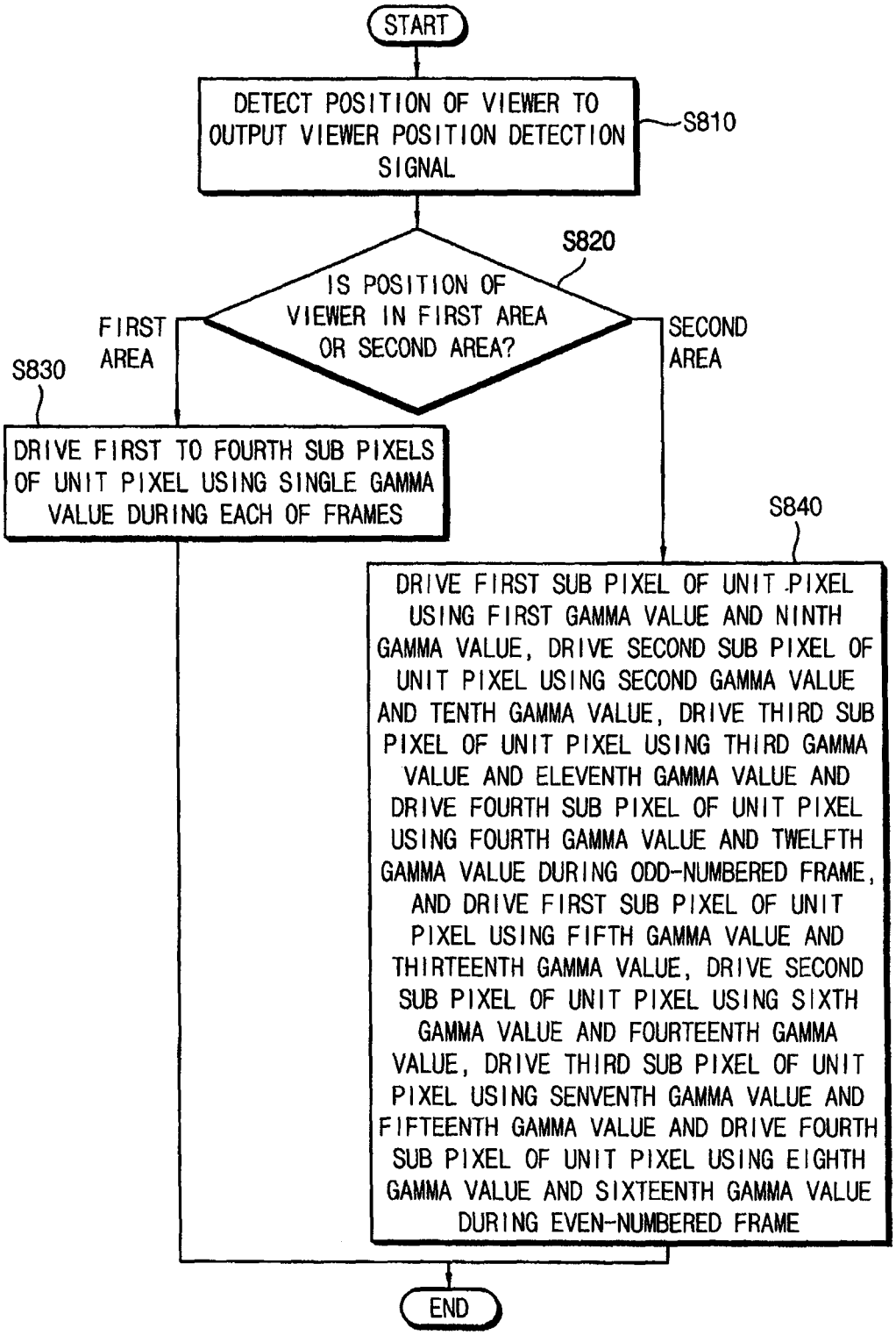
FIG. 27 is a flow chart illustrating a method of driving a display panel performed by the display panel driving apparatus of FIG. 1 driving the unit pixel of FIGS. 25 and 26.

FIG. 27 is a flow chart illustrating a method of driving a display panel 110 performed by the display panel driving apparatus 101 of FIG. 1 driving the unit pixel 900 of FIGS. 25 and 26.

Referring to FIGS. 1, 2, and 25 to 27, the position of the viewer is detected and the viewer position detection signal OPDS is outputted (step S810). More specifically, the viewer position detector 171 of the viewer position determining part 170 in FIG. 2 calculates the distance D between the unit pixel 900 and the eyes 180 of the viewer.

In step S820, it is determined whether the position of the viewer is in the first area or the second area. More specifically, the viewer position determiner 172 of the viewer position determining part 170 in FIG. 2 receives the viewer position detection signal OPDS, and determines whether the position of the viewer is in the first area (e.g., less than the reference distance D from the display panel 110) or in the second area (e.g., not less than the reference distance D from the display panel 110) to output the user position signal OPS.

When the position of the viewer is in the first area, the first sub pixel 910, the second sub pixel 920, the third sub pixel 930, and the fourth sub pixel 940 are driven using the single gamma value GAMMA during each of the frames FRAME1 and FRAME2 (step S830). For example, the data driving part 130 of FIG. 1 may output the data signal DS having the single gamma value GAMMA during each of the first and second frames FRAME1 and FRAME2 to drive the first sub pixel 910, the second sub pixel 920, the third sub pixel 930, and the fourth sub pixel 940.

In step S840, when the position of the viewer is in the second area, the first sub pixel 910 is driven using the first gamma value GAMMA1 and the ninth gamma value GAMMA9, the second sub pixel 920 is driven using the second gamma value GAMMA2 and the tenth gamma value GAMMA10, the third sub pixel 930 is driven using the third gamma value GAMMA3 and the eleventh gamma value GAMMA11, and the fourth sub pixel 940 is driven using the fourth gamma value GAMMA4 and the twelfth gamma value GAMMA12 during the odd-numbered frames.

In addition, the first sub pixel 910 is driven using the fifth gamma value GAMMA5 and the thirteenth gamma value GAMMA13, the second sub pixel 920 is driven using the sixth gamma value GAMMA6 and the fourteenth gamma value GAMMA14, the third sub pixel 930 is driven using the seventh gamma value GAMMA7 and the fifteenth gamma value GAMMA15, and the fourth sub pixel 940 is driven using the eighth gamma value GAMMA8 and the sixteenth gamma value GAMMA16 during the even-numbered frames.

For example, the data driving part 130 of FIG. 1 may output the data signal DS having the first gamma value GAMMA1 and the data signal DS having the ninth gamma value GAMMA9 to drive the first sub pixel 910, may output the data signal DS having the second gamma value GAMMA2 and the data signal DS having the tenth gamma value GAMMA10 to drive the second sub pixel 920, may output the data signal DS having the third gamma value GAMMA3 and the data signal DS having the eleventh gamma value GAMMA11 to drive the third sub pixel 930, and may output the data signal DS having the fourth gamma value GAMMA4 and the data signal DS having the twelfth gamma value GAMMA12 to drive the fourth sub pixel 940 during the odd-numbered frames.

In addition, the data driving part 130 may output the data signal DS having the fifth gamma value GAMMA5 and the data signal DS having the thirteenth gamma value GAMMA13 to drive the first sub pixel 910, may output the data signal DS having the sixth gamma value GAMMA6 and the data signal DS having the fourteenth gamma value GAMMA14 to drive the second sub pixel 920, may output the data signal DS having the seventh gamma value GAMMA7 and the data signal DS having the fifteenth gamma value GAMMA15 to drive the third sub pixel 930, and may output the data signal DS having the eighth gamma value GAMMA8 and the data signal DS having the sixteenth gamma value GAMMA16 to drive the fourth sub pixel 940 during the even-numbered frames.

According to the present embodiment, the unit pixel 900 is driven using the first to sixteenth gamma values GAMMA1, GAMMA2, . . . , and GAMMA16 and therefore, side visibility of the display apparatus 100 may be improved. In addition, when the viewer is in the first area where the viewer may recognize a change of resolution of an image, the unit pixel 900 is driven using the single gamma value GAMMA and therefore, a decrease of the resolution of the image displayed on the display panel 110 may be reduced or prevented.

According to the method of driving a display panel, the display panel driving apparatus and the display apparatus having the display panel driving apparatus, a unit pixel is driven using a plurality of gamma values and therefore, side visibility of the display apparatus may be improved. In addition, when a viewer is in an area where the viewer may recognize a change of resolution of an image when a unit pixel is driven using a plurality of gamma values, the unit pixel is instead driven using a single gamma value and therefore, a decrease of the resolution of the image displayed on a display panel may be reduced or prevented.

The foregoing is illustrative of the present invention and is not to be construed as limiting thereof. Although a few embodiments of the present invention have been described, those skilled in the art will readily appreciate that many modifications are possible in the embodiments without materially departing from the novel teachings and advantages of the present invention. Accordingly, all such modifications are intended to be included within the scope of the present invention as defined in the claims and their equivalents.

In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The present invention is defined by the following claims, with equivalents of the claims to be included therein.

What is claimed is:

1. A method of driving a display panel by a display panel driving apparatus comprising a viewer position determining part and a data driving part, the method comprising:

detecting by the viewer position determining part a position of a viewer to output a viewer position detection signal;

determining by the viewer position determining part whether the viewer is less than a reference distance from the display panel or not less than the reference distance from the display panel based on the viewer position detection signal; and driving by the data driving part a unit pixel of the display panel using a single gamma value when the viewer is determined by the viewer position determining part to be less than the reference distance from the display panel and using a plurality of gamma values when the viewer is determined by the viewer position determining part to be not less than the reference distance from the display panel.

2. The method of claim 1, wherein the driving of the unit pixel using the plurality of gamma values comprises:

driving a first sub pixel of the unit pixel and a fourth sub pixel of the unit pixel using a first gamma value; and driving a second sub pixel of the unit pixel and a third sub pixel of the unit pixel using a second gamma value.

3. The method of claim 1, wherein the driving of the unit pixel using the plurality of gamma values comprises:

driving a first sub pixel of the unit pixel using a first gamma value and a third gamma value;

driving a second sub pixel of the unit pixel using a second gamma value and a fourth gamma value;

driving a third sub pixel of the unit pixel using the first gamma value and the third gamma value; and driving a fourth sub pixel of the unit pixel using the second gamma value and the fourth gamma value.

4. The method of claim 3, wherein the first gamma value is a white color gamma value, the third gamma value is a black color gamma value, and the second gamma value and the fourth gamma value are between the first gamma value and the third gamma value.

5. The method of claim 1, wherein the driving of the unit pixel using the plurality of gamma values comprises:

driving a first sub pixel of the unit pixel using a first gamma value and a fifth gamma value less than the first gamma value;

driving a second sub pixel of the unit pixel using a second gamma value and a sixth gamma value less than the second gamma value;

driving a third sub pixel of the unit pixel using a third gamma value and a seventh gamma value less than the third gamma value; and driving a fourth sub pixel of the unit pixel using a fourth gamma value and an eighth gamma value less than the fourth gamma value.

6. The method of claim 5, wherein the first gamma value is a white color gamma value, the seventh gamma value is a black color gamma value, and the second gamma value, the third gamma value, and the fourth gamma value are between the first gamma value and the seventh gamma value.

7. The method of claim 1, wherein the driving of the unit pixel using the plurality of gamma values comprises:

driving the unit pixel using a first gamma value and a third gamma value during an odd-numbered frame; and driving the unit pixel using a second gamma value and a fourth gamma value during an even-numbered frame.

8. The method of claim 7, wherein the first gamma value is a white color gamma value, the third gamma value is a black color gamma value, and the second gamma value and the fourth gamma value are between the first gamma value and the third gamma value.

9. The method of claim 1, wherein the driving of the unit pixel using the plurality of gamma values comprises:

driving a first sub pixel of the unit pixel using a first gamma value and a fifth gamma value less than the first gamma value, and driving a second sub pixel of the unit pixel using a third gamma value and a seventh gamma value less than the third gamma value during an odd-numbered frame; and driving the first sub pixel of the unit pixel using a second gamma value and a sixth gamma value less than the second gamma value, and driving the second sub pixel of the unit pixel using a fourth gamma value and an eighth gamma value less than the fourth gamma value during an even-numbered frame.

10. The method of claim 1, wherein the driving of the unit pixel using the plurality of gamma values comprises:

driving a first sub pixel of the unit pixel using a first gamma value and a third gamma value, and driving a second sub pixel of the unit pixel using a second gamma value and a fourth gamma value during an odd-numbered frame; and driving the first sub pixel of the unit pixel using a fifth gamma value and a seventh gamma value, and driving the second sub pixel of the unit pixel using a sixth gamma value and an eighth gamma value during an even-numbered frame.

11. The method of claim 10, wherein the first gamma value is a white color gamma value, the seventh gamma value is a black color gamma value, and the second gamma value, the third gamma value, the fourth gamma value, the fifth gamma value, the sixth gamma value, and the eighth gamma value are between the first gamma value and the seventh gamma value.

12. The method of claim 1, wherein the driving of the unit pixel using the plurality of gamma values comprises:

driving a first sub pixel of the unit pixel using a first gamma value and a ninth gamma value less than the first gamma value, driving a second sub pixel of the unit pixel using a second gamma value and a tenth gamma value less than the second gamma value, driving a third sub pixel of the unit pixel using a third gamma value and an eleventh gamma value less than the third gamma value, and driving a fourth sub pixel of the unit pixel using a fourth gamma value and a twelfth gamma value less than the fourth gamma value during an odd-numbered frame; and driving the first sub pixel of the unit pixel using a fifth gamma value and a thirteenth gamma value less than the fifth gamma value, driving the second sub pixel of the unit pixel using a sixth gamma value and a fourteenth gamma value less than the sixth gamma value, driving the third sub pixel of the unit pixel using a seventh gamma value and a fifteenth gamma value less than the seventh gamma value, and driving the fourth sub pixel of the unit pixel using an eighth gamma value and a sixteenth gamma value less than the eighth gamma value during an even-numbered frame.

13. The method of claim 12, wherein the first gamma value is a white color gamma value, the fifteenth gamma value is a black color gamma value, and the second gamma value, the third gamma value, the fourth gamma value, the fifth gamma value, the sixth gamma value, the seventh gamma value, and the eighth gamma value are between the first gamma value and the fifteenth gamma value.

14. The method of claim 1, wherein the driving of the unit pixel using the plurality of gamma values comprises:

driving the unit pixel using a first gamma value during a first frame;

driving the unit pixel using a second gamma value during a second frame;

driving the unit pixel using a third gamma value during a third frame; and driving the unit pixel using a fourth gamma value during a fourth frame.

15. A display panel driving apparatus for driving a display panel, the display panel driving apparatus comprising:

a viewer position determining part configured to detect a position of a viewer to output a viewer position detection signal, and determine whether the viewer is less than a reference distance from the display panel or not less than the reference distance from the display panel based on the viewer position detection signal; and a data driving part configured to drive a unit pixel of the display panel using a single gamma value when the viewer is determined by the viewer position determining part to be less than the reference distance from the display panel and using a plurality of gamma values when the viewer is determined by the viewer position determining part to be not less than the reference distance from the display panel.

16. A display apparatus comprising:

a display panel configured to display an image and comprising a gate line and a data line; and a display panel driving apparatus comprising a gate driving part configured to output a gate signal to the gate line, a viewer position determining part configured to detect a position of a viewer viewing the image to output a viewer position detection signal, and determine whether the viewer is less than a reference distance from the display panel or not less than the reference distance from the display panel based on the viewer position detection signal, and a data driving part configured to drive a unit pixel of the display panel using a single gamma value when the viewer is determined by the viewer position determining part to be less than the reference distance from the display panel and using a plurality of gamma values when the viewer is determined by the viewer position determining part to be not less than the reference distance from the display panel.

* * * * *